US012397893B2

(12) United States Patent
Mizutani et al.

(10) Patent No.: US 12,397,893 B2
(45) Date of Patent: Aug. 26, 2025

(54) OUTBOARD MOTOR AND ANTI-VIBRATION STRUCTURE OF OUTBOARD MOTOR

(71) Applicant: YAMAHA HATSUDOKI KABUSHIKI KAISHA, Iwata (JP)

(72) Inventors: Makoto Mizutani, Shizuoka (JP); Motosumi Yamanouchi, Shizuoka (JP); Takuma Matsunaga, Shizuoka (JP); Tomohiro Hagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 563 days.

(21) Appl. No.: 17/939,311

(22) Filed: Sep. 7, 2022

(65) Prior Publication Data

US 2023/0150638 A1 May 18, 2023

(30) Foreign Application Priority Data

Nov. 12, 2021 (JP) ..... 2021-185232

(51) Int. Cl.
*B63H 21/30* (2006.01)
*B63H 20/06* (2006.01)
*B63H 20/12* (2006.01)

(52) U.S. Cl.
CPC ..... *B63H 21/305* (2013.01); *B63H 20/06* (2013.01); *B63H 20/12* (2013.01)

(58) Field of Classification Search
CPC ..... B63H 21/305; B63H 20/06; B63H 20/12
See application file for complete search history.

(56) References Cited

U.S. PATENT DOCUMENTS

2005/0250394 A1 11/2005 Nakamura et al.
2012/0094557 A1* 4/2012 Takase ..... B63H 20/12 440/53
2017/0314461 A1 11/2017 Mizutani et al.

FOREIGN PATENT DOCUMENTS

JP H02158495 A 6/1990
JP 09-11988 A 1/1997
JP 2005329829 A 12/2005
JP 2006015978 A 1/2006
JP 2007290644 A 11/2007
JP 2018192914 A 12/2018

OTHER PUBLICATIONS

Office Action in JP2021-185232, mailed Jun. 29, 2023, 4 pages.

* cited by examiner

*Primary Examiner* — Stephen P Avila
(74) *Attorney, Agent, or Firm* — Keating & Bennett, LLP

(57) ABSTRACT

An outboard motor includes an outboard motor main body and a mount assembly to mount the outboard motor main body to a hull. The mount assembly includes a clamp bracket to be fixed to the hull, a swivel bracket to support the outboard motor main body, and a hydraulic cylinder. The swivel bracket is coupled to the clamp bracket through a tilt shaft and turnable around the tilt shaft. The hydraulic cylinder is located between the clamp bracket and the swivel bracket and is able to turn the swivel bracket around the tilt shaft with respect to the clamp bracket. The outboard motor includes a gas damper to damp an external force that acts in a telescopic direction of the hydraulic cylinder.

16 Claims, 13 Drawing Sheets

OUTBOARD MOTOR AND ANTI-VIBRATION STRUCTURE OF OUTBOARD MOTOR

CROSS REFERENCE TO RELATED APPLICATIONS

This application claims the benefit of priority to Japanese Patent Application No. 2021-185232 filed on Nov. 12, 2021. The entire contents of this application are hereby incorporated herein by reference.

BACKGROUND OF THE INVENTION

1. Field of the Invention

The present invention relates to an outboard motor and an anti-vibration structure of an outboard motor.

2. Description of the Related Art

Japanese Laid-open Patent Application Publication No. H9-11988 discloses a tilt/trim device of a vessel propulsion apparatus. This device is configured so that hydraulic oil is supplied from a pumping device to a hydraulic cylinder device located between a swivel bracket of an outboard motor and a hull. A propulsion unit of the outboard motor is tilt-operated or trim-operated by the extension and contraction of the hydraulic cylinder device.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

An engine rotates at a low speed during low-speed navigation, such as trolling. At this time, low-frequency vibrations are transmitted from the outboard motor to a hull. If these vibrations can be reduced, a comfortable ride on the vessel can be improved.

Preferred embodiments of the present invention provide outboard motors that each significantly reduces or prevents vibrations transmitted to a hull, and anti-vibration structures of the outboard motors.

In order to overcome the previously unrecognized and unsolved challenges described above, a preferred embodiment of the present invention provides an outboard motor including an outboard motor main body and a mount assembly to mount the outboard motor main body to a hull. The mount assembly includes a clamp bracket to be fixed to the hull and a swivel bracket that is coupled to the clamp bracket through a tilt shaft, turnable around the tilt shaft, and supports the outboard motor main body. The outboard motor further includes a hydraulic cylinder located between the clamp bracket and the swivel bracket and that is able to turn the swivel bracket around the tilt shaft with respect to the clamp bracket. The outboard motor further includes a gas damper to damp an external force that acts in a telescopic direction of the hydraulic cylinder. According to this structural configuration, an external force that acts in the telescopic direction of the hydraulic cylinder that turns the swivel bracket around the tilt shaft is attenuated by the gas damper. Therefore, it is possible to significantly reduce or prevent vibrations transmitted to the hull.

In a preferred embodiment of the present invention, the hydraulic cylinder includes a cylinder main body, a piston that is slidable in the cylinder main body and that defines a pair of oil chambers in the cylinder main body, and a rod that extends outwardly from the cylinder main body through one of the pair of oil chambers. The hydraulic cylinder extends and contracts the rod by selectively supplying hydraulic oil from a hydraulic circuit to either one of the pair of oil chambers. Additionally, the gas damper is provided in the cylinder main body and is filled with gas. According to this structural configuration, the gas damper functions as a damper, and, as a result, an external force that acts in the telescopic direction of the hydraulic cylinder is attenuated. Therefore, it is possible to significantly reduce or prevent vibrations transmitted to the hull.

In a preferred embodiment of the present invention, the gas damper includes a free piston that is slidable in the cylinder main body on a side opposite to the rod and that defines a gas chamber filled with the gas in the cylinder main body. According to this structural configuration, gas with which the gas chamber defined by the free piston in the cylinder main body of the hydraulic cylinder is filled functions as a damper, and, as a result, an external force that acts in the extension/contraction direction of the hydraulic cylinder is attenuated. Therefore, it is possible to significantly reduce or prevent vibrations transmitted to the hull.

In a preferred embodiment of the present invention, the cylinder main body includes a contact portion that is contactable with the free piston so as to regulate a position of a stroke end of the free piston and that regulates a minimum volume of the gas chamber. According to this structural configuration, an increase of the pressure in the gas chamber is regulated.

In a preferred embodiment of the present invention, the hydraulic cylinder includes a cylinder main body, a piston that is slidable in the cylinder main body and that defines a pair of oil chambers in the cylinder main body, and a rod that extends outwardly from the cylinder main body through one of the pair of oil chambers. The hydraulic cylinder extends and contracts the rod by selectively supplying hydraulic oil from a hydraulic circuit to either one of the pair of oil chambers. The gas damper includes a sub-cylinder that is hydraulically connected to at least one of the pair of oil chambers.

According to this structural configuration, the sub-cylinder that is hydraulically connected to at least one of the oil chambers of the hydraulic cylinder functions as a gas damper, and, as a result, an external force that acts in the extension/contraction direction of the hydraulic cylinder is attenuated. Therefore, it is possible to significantly reduce or prevent vibrations transmitted to the hull.

In a preferred embodiment of the present invention, the sub-cylinder includes a sub-cylinder main body and a free piston that is slidable in the sub-cylinder main body. The free piston divides a sub-oil chamber in communication with at least one of the pair of oil chambers of the hydraulic cylinder and a gas chamber filled with the gas from each other. According to this structural configuration, the gas with which the gas chamber divided from the sub-oil chamber by the free piston in the sub-cylinder main body is filled functions as a damper, and, as a result, an external force that acts in the extension/contraction direction of the hydraulic cylinder is attenuated. Therefore, it is possible to significantly reduce or prevent vibrations transmitted to the hull.

In a preferred embodiment of the present invention, the sub-cylinder main body includes a contact portion that is contactable with the free piston so as to regulate a position of a stroke end of the free piston and that regulates a minimum volume of the gas chamber. According to this structural configuration, an increase of the pressure in the gas chamber is regulated.

In a preferred embodiment of the present invention, the sub-cylinder includes a pair of sub-cylinders. Sub-oil chambers of the pair of sub-cylinders are connected to the pair of oil chambers of the hydraulic cylinder, respectively. According to this structural configuration, each of the sub-cylinders that respectively correspond to the extension and the contraction of the hydraulic cylinder functions as a gas damper. Thus, it is possible to attenuate an extension/contraction bidirectional external force. Therefore, the attenuation effect is high. This makes it possible to further significantly reduce or prevent vibrations transmitted to the hull.

In a preferred embodiment of the present invention, the sub-cylinder includes only a single sub-cylinder, and both of the pair of oil chambers of the hydraulic cylinder are in communication with the sub-oil chamber of the single sub-cylinder. According to this structural configuration, the sub-cylinder common to the extension and the contraction of the hydraulic cylinder is able to function as a gas damper.

In a preferred embodiment of the present invention, the sub-cylinder includes only a single sub-cylinder, and the gas chamber includes a pair of gas chambers, and the sub-oil chamber includes a pair of sub-oil chambers. The pair of oil chambers of the hydraulic cylinder are in communication with the sub-oil chambers corresponding to the pair of oil chambers, respectively. The free piston includes a rod piston that includes a gas piston that divides the pair of gas chambers from each other and a pair of rods that extend from the gas piston to both sides in a sliding direction of the free piston. Each of the pair of rods functions as a hydraulic piston that defines a portion of the sub-oil chamber corresponding to the rod. According to this structural configuration, the sub-cylinder common to the extension and the contraction of the hydraulic cylinder is able to function as a gas damper.

In a preferred embodiment of the present invention, the outboard motor further includes an on-off valve to interrupt a flow of hydraulic oil between at least one of the pair of oil chambers of the hydraulic cylinder and the sub-oil chamber of the sub-cylinder. According to this structural configuration, gas with which the gas chamber of the sub-cylinder is filled functions as a damper in a state in which a flow of hydraulic oil between at least one of the pair of oil chambers of the hydraulic cylinder and the sub-oil chamber of the sub-cylinder is allowed by the on-off valve. Thus, an external force that acts in the extension/contraction direction of the hydraulic cylinder is attenuated. Therefore, it is possible to significantly reduce or prevent vibrations transmitted to the hull.

In a preferred embodiment of the present invention, the outboard motor further includes a prime mover to rotate a propeller, a detector to detect a rotation speed of the prime mover, and a controller configured or programmed to shut off a control valve, which is the on-off valve, when a rotation speed detected by the detector exceeds a predetermined threshold value. According to this structural configuration, gas with which the gas chamber of the sub-cylinder is filled functions as a damper when a detection value of the rotation speed of the prime mover is lower than the threshold value. Therefore, it is possible to significantly reduce or prevent vibrations transmitted to the hull.

In a preferred embodiment of the present invention, the hydraulic cylinder includes a cylinder main body, a piston that is slidable in the cylinder main body and that defines a pair of oil chambers in the cylinder main body, and a rod that extends outwardly from the cylinder main body through one of the pair of oil chambers. The hydraulic cylinder extends and contracts the rod by selectively supplying hydraulic oil from a hydraulic circuit to either one of the pair of oil chambers. Additionally, the gas damper includes a gas cylinder that slidably houses an end portion of the cylinder main body on a side opposite to the rod and that defines a gas chamber, filled with gas, with the end portion of the cylinder main body.

According to this structural configuration, the gas cylinder that slidably houses the end portion of the cylinder main body on the side opposite to the rod functions as a gas damper, and, as a result, an external force that acts in the extension/contraction direction of the hydraulic cylinder is attenuated. Therefore, it is possible to significantly reduce or prevent vibrations transmitted to the hull.

In a preferred embodiment of the present invention, the gas cylinder includes a contact portion that is contactable with the end portion of the cylinder main body. The contact portion regulates a minimum volume of the gas chamber by regulating a position of a stroke end of the end portion of the cylinder main body with respect to the gas cylinder. According to this structural configuration, an increase of the pressure in the gas chamber is regulated.

In a preferred embodiment of the present invention, the hydraulic cylinder includes a cylinder main body, a piston that is slidable in the cylinder main body and that defines a pair of oil chambers in the cylinder main body, and a rod that extends outwardly from the cylinder main body through one of the pair of oil chambers. The hydraulic cylinder extends and contracts the rod by selectively supplying hydraulic oil from a hydraulic circuit to either one of the pair of oil chambers. Additionally, the piston includes a hollow piston having a cylindrical inner peripheral surface that defines a gas chamber filled with gas. Additionally, the gas damper includes a double piston structure including the hollow piston and an internal piston that is housed in the hollow piston slidably on the inner peripheral surface, coupled to the rod, and partitions the gas chamber into a pair of gas chambers.

According to this structural configuration, the internal piston performs a stroke in the hollow piston in response to the extension/contraction of the rod, and, as a result, gas in a corresponding one of the gas chambers in the hollow piston is compressed. Thus, an external force that acts in the extension/contraction direction of the hydraulic cylinder is attenuated. Therefore, it is possible to significantly reduce or prevent vibrations transmitted to the hull.

In a preferred embodiment of the present invention, the hollow piston includes a contact portion that is contactable with the internal piston and that regulates a minimum volume of the gas chamber by regulating a position of a stroke end of the internal piston with respect to the hollow piston. According to this structural configuration, an increase of the pressure in the gas chamber is regulated.

In a preferred embodiment of the present invention, the hydraulic cylinder includes a cylinder main body, a piston that is slidable in the cylinder main body and that defines a pair of oil chambers in the cylinder main body, and a rod that extends outwardly from the cylinder main body through one of the pair of oil chambers. The hydraulic cylinder extends and contracts the rod by selectively supplying hydraulic oil from a hydraulic circuit to either one of the pair of oil chambers. Additionally, the gas damper includes a pair of independent foam structures located in the pair of oil chambers, respectively. According to this structural configuration, an external force that acts in the extension/contraction direction of the hydraulic cylinder is attenuated by the independent foam structure located in each of the oil chambers. Therefore, it is possible to significantly reduce or prevent vibrations transmitted to the hull.

In a preferred embodiment of the present invention, the hydraulic cylinder includes a cylinder main body, a piston that is slidable in the cylinder main body and that defines a pair of oil chambers in the cylinder main body, and a rod that extends outwardly from the cylinder main body through one of the pair of oil chambers. The hydraulic cylinder extends and contracts the rod by selectively supplying hydraulic oil from a hydraulic circuit to either one of the pair of oil chambers. Additionally, the gas damper includes a movable partition that defines a gas chamber filled with gas in the hydraulic cylinder or in a sub-cylinder that is hydraulically connected to the hydraulic cylinder.

According to this structural configuration, gas, for example, in the gas chamber defined by the movable partition in the hydraulic cylinder functions as a damper, and, as a result, an external force that acts in the extension/contraction direction of the hydraulic cylinder is attenuated. Therefore, it is possible to significantly reduce or prevent vibrations transmitted to the hull.

In a preferred embodiment of the present invention, the mount assembly further includes an elastic mount that elastically supports the outboard motor main body with respect to the swivel bracket, and the gas damper functions as a gas spring having a spring constant lower than a spring constant of the elastic mount. According to this structural configuration, it becomes possible to extend and contract the gas damper even when an external force that acts in the extension/contraction direction of the hydraulic cylinder is small. Therefore, it is possible to improve an anti-vibration effect, and it is possible to further significantly reduce or prevent vibrations transmitted to the hull.

In another preferred embodiment of the present invention, an anti-vibration structure of an outboard motor includes a hydraulic cylinder that is able to turn an outboard motor main body around a tilt shaft coupled to a clamp bracket fixed to a hull and a gas damper to damp an external force that acts in a telescopic direction of the hydraulic cylinder. According to this structural configuration, an external force acting in the extension/contraction direction of the hydraulic cylinder that turns the outboard motor main body is attenuated by the gas damper. Therefore, it is possible to significantly reduce or prevent vibrations transmitted to the hull.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
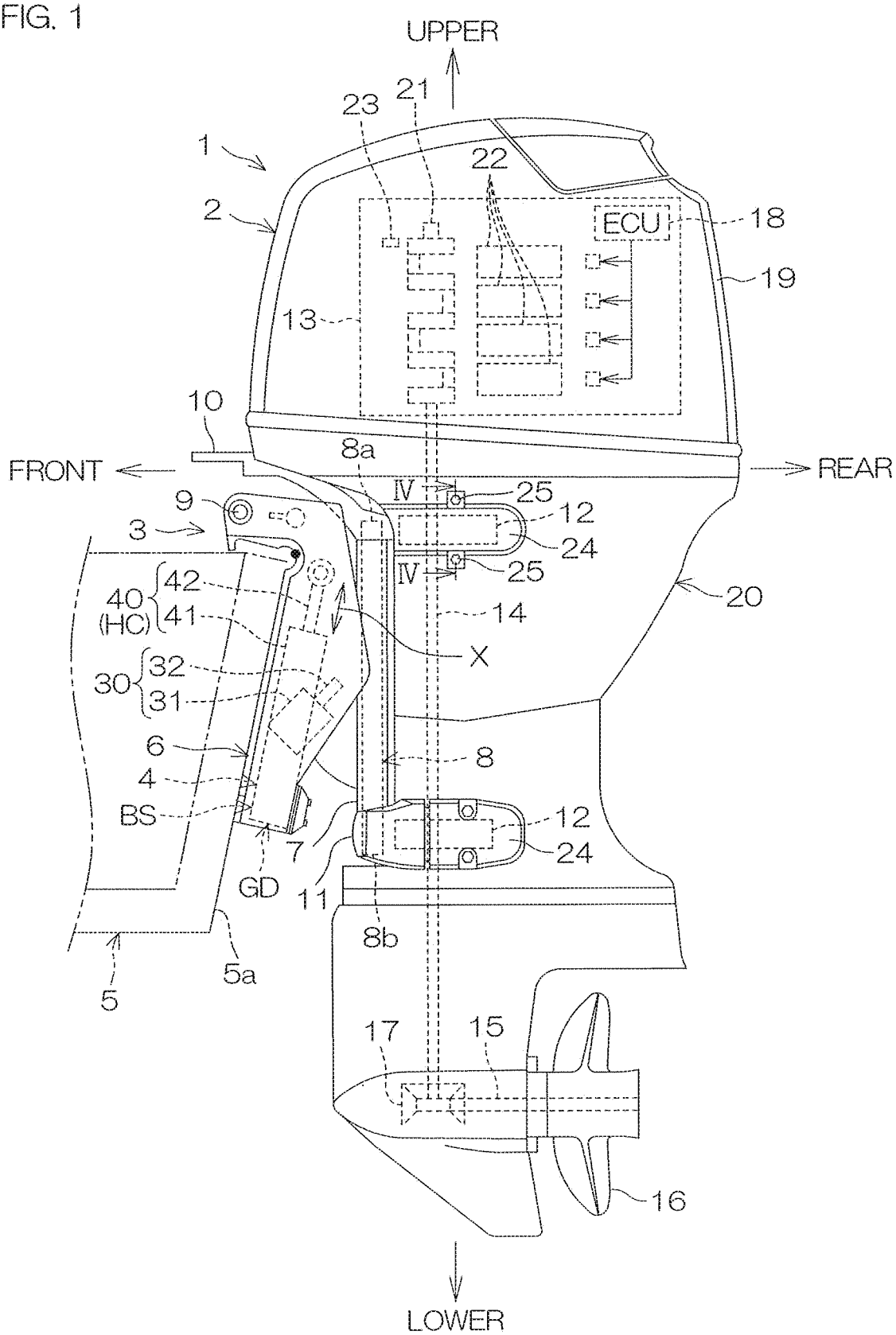
FIG. 1 is a side view shown to describe an example of an outboard motor according to a preferred embodiment of the present invention.

FIG. 1 is a side view shown to describe an example of an outboard motor 1 according to a preferred embodiment of the present invention. The outboard motor 1 includes an outboard motor main body 2, a mount assembly 3, and a power trim & tilt mechanism 4 (hereinafter, referred to as "PTT mechanism 4"). The outboard motor main body 2 is attached to a rear portion of a hull 5*a* of a vessel 5 by the mount assembly 3.

The mount assembly 3 includes a swivel bracket 7, a clamp bracket 6, a steering shaft 8, a tilt shaft 9, an upper bracket 10, a lower bracket 11, and a plurality of anti-vibration mounts 12. The steering shaft 8 extends in an up-down direction. The tilt shaft 9 extends horizontally or substantially horizontally in a left-right direction (direction perpendicular to the plane of paper of FIG. 1). The swivel bracket 7 is coupled to the outboard motor main body 2 through the steering shaft 8. The PTT mechanism 4 is an example of a turning mechanism that turns the outboard motor main body 2 around the tilt shaft 9 and tilts the outboard motor main body 2 with respect to the clamp bracket 6. The anti-vibration mounts 12 are located on the upper and lower sides. The anti-vibration mount 12 is an example of an elastic mount that elastically supports the outboard motor main body 2 with respect to the swivel bracket 7.

The upper bracket 10 and the lower bracket 11 are each an example of a bracket by which the outboard motor main body 2 is attached to the hull 5*a*. The upper bracket 10 is fixed to an upper end portion 8*a* of the steering shaft 8. The lower bracket 11 is fixed to a lower end portion 8*b* of the steering shaft 8. The upper bracket 10 and the lower bracket 11 are each coupled to the outboard motor main body 2 through the anti-vibration mount 12.

The outboard motor main body 2 is attached to the hull 5*a* in a substantially vertical attitude by the mount assembly 3. The clamp bracket 6 is fixed to the hull 5*a*. The swivel bracket 7 is coupled to the clamp bracket 6 through the tilt shaft 9 so as to turn around the tilt shaft 9, and supports the outboard motor main body 2. The outboard motor main body 2 and the swivel bracket 7 are turnable around the tilt shaft 9 upwardly and downwardly with respect to the clamp bracket 6. The outboard motor main body 2 and the swivel bracket 7 are turned around the tilt shaft 9 upwardly and downwardly by the PTT mechanism 4. The PTT mechanism 4 is actuated by operating a PTT operation switch (not shown). Therefore, the outboard motor main body 2 is tilted with respect to the clamp bracket 6 by the operation of the PTT operation switch. As a result, it is possible to change the inclination angle of the outboard motor main body 2 with respect to the hull 5*a*, and therefore it is possible to make a trim adjustment and to tilt up/down the outboard motor main body 2. The outboard motor 1 includes an anti-vibration structure BS of the outboard motor (hereinafter, referred to simply as an "anti-vibration structure BS" if necessary) that fulfills a function to significantly reduce or prevent vibrations transmitted to the hull 5*a* by use of a portion of the PTT mechanism 4.

The PTT mechanism 4 includes a trim cylinder 30 to make a trim adjustment and a tilt cylinder 40 to tilt up/down the outboard motor main body 2. The trim cylinder 30 includes a cylinder main body 31 and a trim rod 32. The tilt cylinder 40 includes a cylinder main body 41 and a tilt rod 42. The tilt cylinder 40 is joined between the clamp bracket 6 and the swivel bracket 7. The tilt cylinder 40 turns the swivel bracket 7 around the tilt shaft 9 with respect to the clamp bracket 6. The tilt cylinder 40 is an example of a hydraulic cylinder HC applied to the anti-vibration structure BS. The anti-vibration structure BS includes a gas damper GD to damp an external force that acts in an expansion/contraction direction X (a telescopic direction) of the hydraulic cylinder HC.

Additionally, the outboard motor main body 2 is turnable around the steering shaft 8 rightwardly and leftwardly with respect to the swivel bracket 7. A steering wheel (not shown) is operated, and, as a result, the outboard motor main body 2 is turned around the steering shaft 8 rightwardly and leftwardly. This makes it possible to steer the vessel 5.

The outboard motor main body 2 includes an engine 13 as an example of a prime mover, a drive shaft 14, a propeller shaft 15, a propeller 16 as an example of a thrust generating member, a forward-reverse switching mechanism 17 as an example of a clutch, and an ECU (Electronic Control Unit) 18 as an example of a controller. Additionally, the outboard motor main body 2 includes an engine cover 19 and a casing 20. The engine 13 and the ECU 18 are housed in the engine cover 19. Additionally, the drive shaft 14 extends upwardly and downwardly in the engine cover 19 and the casing 20. The propeller shaft 15 extends in a front-rear direction in a lower portion of the casing 20. An upper end portion of the drive shaft 14 is coupled to the engine 13. A lower end portion of the drive shaft 14 is coupled to a front end portion of the propeller shaft 15 by the forward-reverse switching mechanism 17. The propeller 16 is coupled to a rear end portion of the propeller shaft 15. The propeller 16 rotates together with the propeller shaft 15. The propeller 16 is rotationally driven by the engine 13. In other words, the engine 13 rotates the propeller 16.

The engine 13 may be, for example, an internal combustion engine that burns fuel, such as gasoline, to generate power. The engine 13 includes a crankshaft 21, a plurality of (for example, four) cylinders 22, and a rotation speed detector 23. The engine 13 is oriented such that the crankshaft 21 extends vertically. The upper end portion of the drive shaft 14 is joined to the crankshaft 21. The crankshaft 21 is rotationally driven around a vertical axis by combustion in each of the cylinders 22. The rotation speed of the crankshaft 21 (rotation speed of the engine 13) is detected by both the rotation speed detector 23 and the ECU 18. The rotation speed detector 23 outputs a detection signal that synchronizes with the rotation of the crankshaft 21. The ECU 18 calculates the engine rotation speed based on the detection signal.

Figure 2:
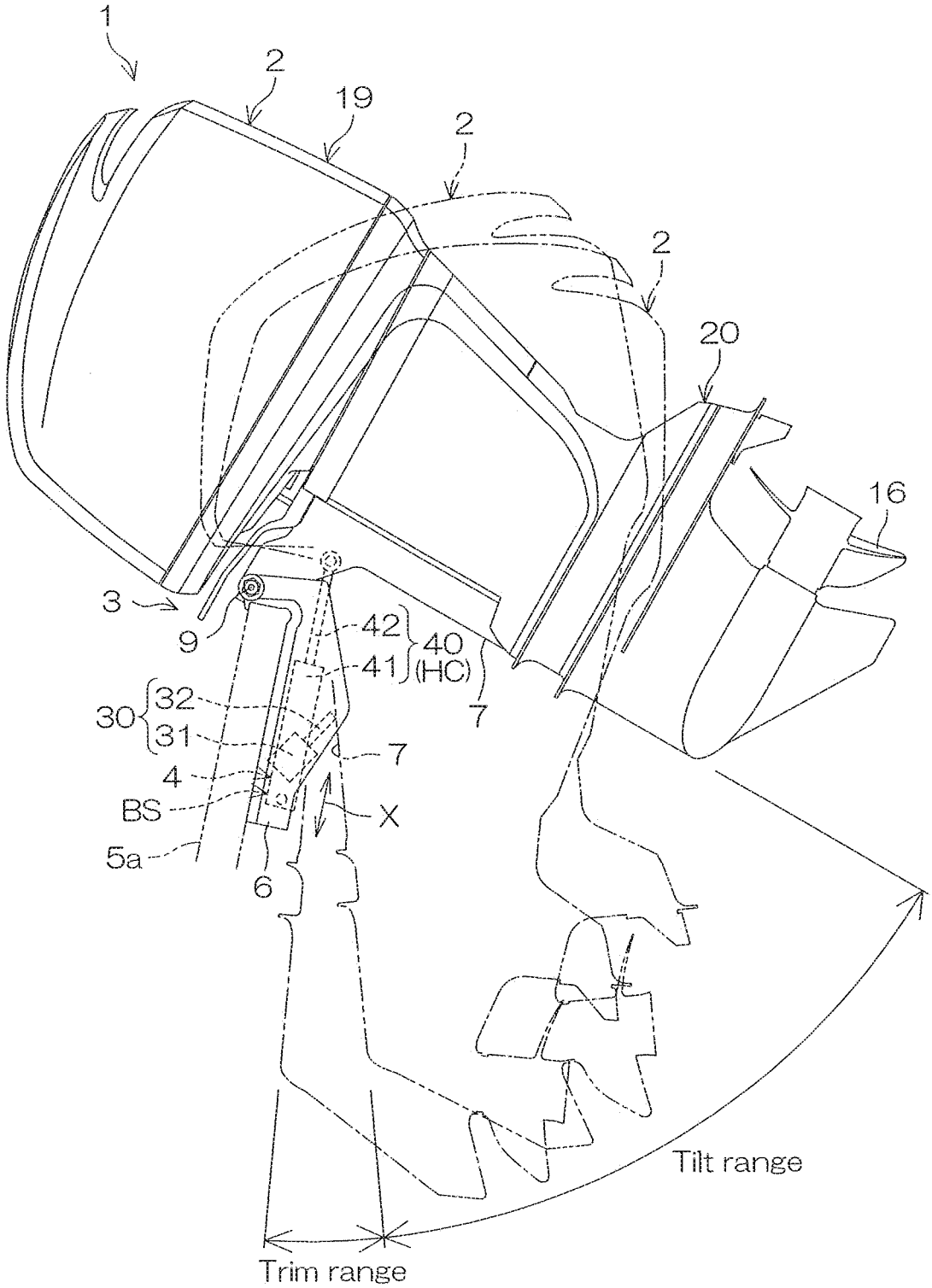
FIG. 2 is a descriptive view showing a state in which an outboard motor main body has been tilted up.

FIG. 2 is a side view showing a state in which the outboard motor main body 2 has been tilted up (a state in which the inclination angle is within a tilt range). The outboard motor main body 2 is turned around the tilt shaft 9 between a substantially vertical attitude and an attitude in which the outboard motor main body 2 is largely inclined while directing a front surface of the outboard motor main body 2 (front surface of the engine cover 19 and front surface of the casing 20) toward the lower side as shown in FIG. 2. If the inclination angle of the outboard motor main body 2 when a lower end of the drive shaft 14 becomes closest to the hull 5*a* is assumed as zero, the range within which the inclination angle of the outboard motor main body 2 is small is a trim range, and the range within which the inclination angle of the outboard motor main body 2 is larger than an upper-limit boundary value of the trim range is a tilt range. In FIG. 2, a state in which the inclination angle of the outboard motor main body 2 is a lower-limit boundary value of the trim range is shown by an alternate long and short dashed line, whereas a state in which the inclination angle of the outboard motor main body 2 is the upper-limit boundary value of the trim range is shown by an alternate long and two short dashed line. Additionally, in FIG. 2, a state in which the inclination angle of the outboard motor main body 2 is an upper limit value of the tilt range (full-tilt-up) is shown by a solid line. The upper limit value of the tilt range is, for example, a maximum value of the inclination angle of the outboard motor main body 2. The outboard motor main body 2 is able to be held at an arbitrary position of the trim range and of the tilt range.

"Turning the outboard motor main body 2 upwardly within a trim range" is referred to as "trim up," and "turning the outboard motor main body 2 downwardly within a trim range" is referred to as "trim down." As a more functional definition, "turning the outboard motor main body 2 upwardly for a trim adjustment of the vessel" is referred to as "trim up," and "turning the outboard motor main body 2 downwardly for a trim adjustment of the vessel" is referred to as "trim down." On the other hand, "turning the outboard motor main body 2 upwardly with the aim of raising the propeller 16 over the surface of water" is referred to as "tilt up," and "turning the outboard motor main body 2 downwardly with the aim of lowering the propeller 16 under the surface of water" is referred to as "tilt down." Therefore, there is a case in which "tilt up" and "tilt down" are used for the up-and-down movement of the outboard motor main body 2 in both the trim range and the tilt range.

Figure 3:
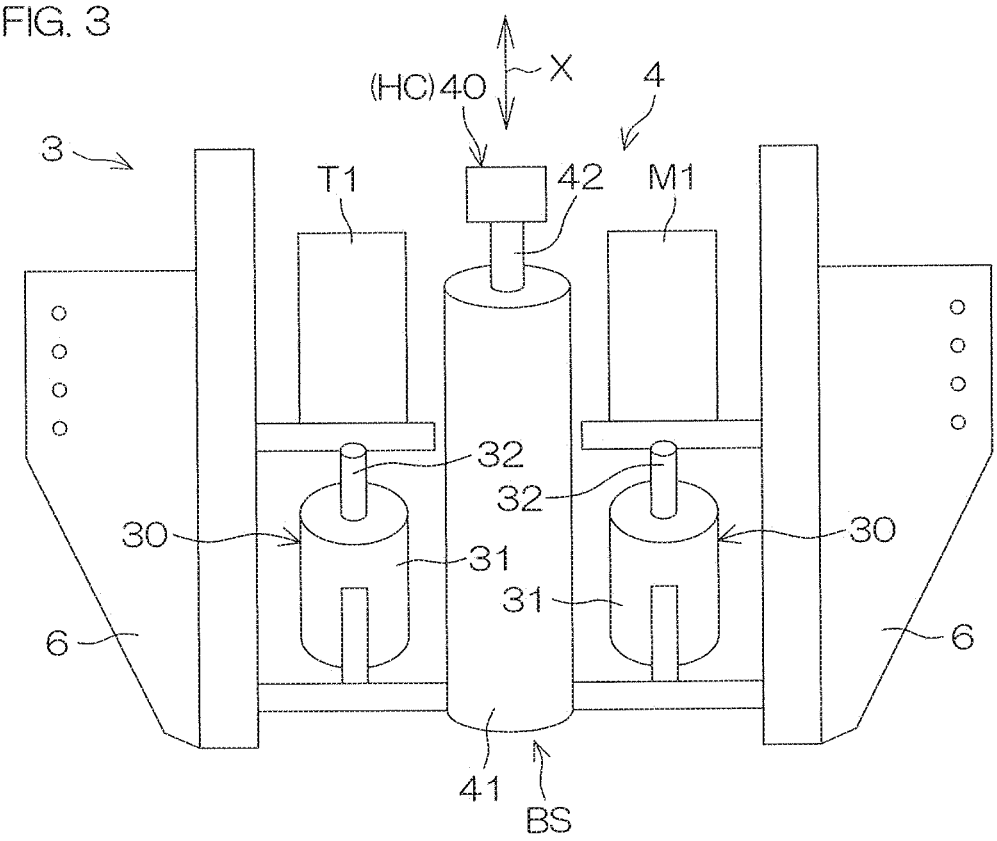
FIG. 3 is a schematic view of a mount assembly that attaches the outboard motor main body to a vessel.

FIG. 3 is a schematic view of the mount assembly 3, and shows a state of a portion of the mount assembly 3 seen from the rear. The clamp bracket 6 includes a pair of clamp brackets 6 as shown in FIG. 3. The pair of clamp brackets 6 are located at a distance from each other in the left-right direction. A portion of the swivel bracket 7 and the PTT mechanism 4 are located between the pair of clamp brackets 6.

The PTT mechanism 4 includes, for example, two trim cylinders 30 and a single tilt cylinder 40. Each of the trim cylinders 30 and the tilt cylinder 40 are located between the two clamp brackets 6. The two trim cylinders 30 are located so as to coincide with each other when seen from the left-right direction of the hull 5*a*. The two trim cylinders 30 are located on both the right/left sides of the tilt cylinder 40. Each of the trim cylinders 30 is obliquely located along the front-rear direction of the vessel so that an upper end of the trim cylinder 30 is placed at a more rearward position than a lower end of the trim cylinder 30. Likewise, the tilt cylinder 40 is obliquely located along the front-rear direction of the vessel so that an upper end of the tilt cylinder 40 is placed at a more rearward position than a lower end of the tilt cylinder 40. Each of the trim cylinders 30 and the tilt cylinder 40 are each, for example, a hydraulic cylinder. A tank T1 in which hydraulic oil is stored and an electric motor M1 that drives a hydraulic pump that supplies hydraulic oil are located between the two clamp brackets 6 as shown in FIG. 3. The outboard motor main body 2 and the swivel bracket 7 are turned around the tilt shaft 9 by each of the trim cylinders 30 and the tilt cylinder 40. The electric motor M1 and the hydraulic pump are one example of an electrically-operated actuator in a preferred embodiment of the present invention, and supply a driving force to the PTT mechanism 4.

The cylinder main body 31 of each of the trim cylinders 30 is coupled to a corresponding one of the clamp brackets 6. The trim rod 32 obliquely upwardly protrudes from an upper end portion of the cylinder main body 31 toward the rear. The trim rod 32 is reciprocated in an axial direction of the trim rod 32 by hydraulic pressure in the cylinder main body 31. An upper end portion of each of the trim rods 32 comes into contact with the swivel bracket 7 in a state in which the inclination angle of the outboard motor main body 2 is within the trim range as shown by the alternate long and two short dashed line in FIG. 2. Therefore, in this state, the outboard motor main body 2 is supported from the front side by the two trim rods 32 through the swivel bracket 7. Additionally, when the inclination angle of the outboard motor main body 2 is large and reaches the tilt range, the upper end portion of each of the trim rods 32 is separated from the swivel bracket 7. Therefore, the support of the outboard motor main body 2 by the two trim rods 32 is released.

The inclination angle of the outboard motor main body 2 when the trim rods 32 are in contact with the swivel bracket 7 in a maximum expansion state is the upper-limit boundary value of the trim range. In other words, the upper-limit boundary value of the trim range is defined by the upper limit value of the inclination angle that is changeable by driving the trim cylinder 30. On the other hand, a minimum value of the inclination angle that can be taken by the outboard motor main body 2 when the trim rod 32 is in a minimum expansion state, i.e., in a contracted state is the lower-limit boundary value of the trim range.

A lower end portion of the cylinder main body 41 of the tilt cylinder 40 is coupled to the clamp bracket 6. The tilt rod 42 obliquely upwardly protrudes from an upper end portion of the cylinder main body 41 toward the rear. An upper end portion of the tilt rod 42 is coupled to the swivel bracket 7. The tilt rod 42 is reciprocated in an axial direction of the tilt rod 42 by hydraulic pressure in the cylinder main body 41. The upper end portion of the tilt rod 42 is coupled to the swivel bracket 7 even in a state in which the inclination angle of the outboard motor main body 2 is within either of the trim range and the tilt range. Therefore, the outboard motor main body 2 is supported by the tilt cylinder 40 even in a state in which the inclination angle of the outboard motor main body 2 is within either of the trim range and the tilt range.

In a state in which the inclination angle of the outboard motor main body 2 is within the trim range, the outboard motor main body 2 is supported by the two trim cylinders 30 and the single tilt cylinder 40. Additionally, in this state, the outboard motor main body 2 is turned upwardly and downwardly around the tilt shaft 9 by the two trim cylinders 30 and the single tilt cylinder 40. The inclination angle of the outboard motor main body 2 is larger in proportion to an increase in the amount of protrusion of each of the trim rods 32 and the tilt rod 42. Additionally, when the inclination angle of the outboard motor main body 2 is large and reaches the tilt range, the support of the outboard motor main body 2 by the two trim cylinders 30 is released, and the outboard motor main body 2 is supported by the single tilt cylinder 40. In this state, the outboard motor main body 2 is turned upwardly and downwardly around the tilt shaft 9 by the single tilt cylinder 40. The inclination angle of the outboard motor main body 2 becomes larger in proportion to an increase in the amount of protrusion of the tilt rod 42. The inclination angle of the outboard motor main body 2 is changeable within a range from the lower-limit boundary value of the trim range to the upper limit value of the tilt range by the extension and contraction of the tilt rod 42.

Figure 4:
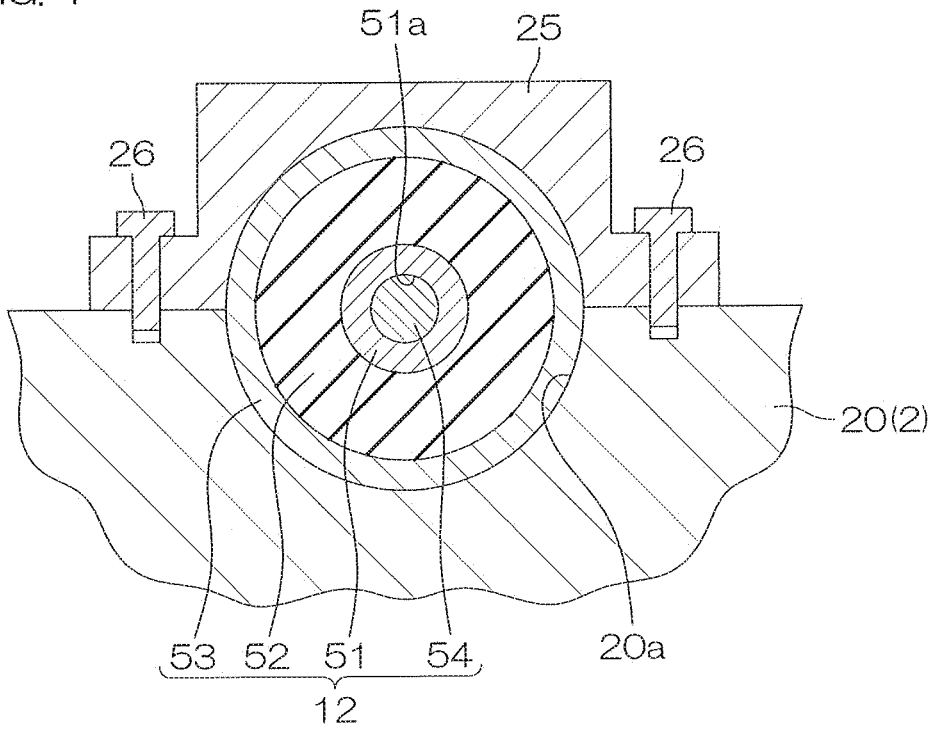
FIG. 4 is a cross-sectional view showing a cross section along line IV-IV of FIG. 1.

FIG. 4 is a cross-sectional view along line IV-IV of FIG. 1. The upper anti-vibration mount 12 includes a shaft portion 51, an elastic portion 52, an outer cylinder portion 53, and a fastener 54 as shown in FIG. 4. The shaft portion 51 is made of metal, such as aluminum, and is integral with the upper bracket 10. A screw hole 51*a* extending along a central axis of the shaft portion 51 is provided in the shaft portion 51. The elastic portion 52 is provided in a circular cylindrical shape with an elastic material, such as rubber or sponge. The elastic portion 52 is coaxially fitted and attached to the shaft portion 51 in a state of surrounding the shaft portion 51.

The outer cylinder portion 53 has a circular cylindrical shape and is made of a metal material, such as aluminum. The outer cylinder portion 53 is coaxially fitted and attached to the elastic portion 52 in a state of surrounding the elastic portion 52. The outer cylinder portion 53 is not in contact with the shaft portion 51. The elastic portion 52 may be always compressed between the shaft portion 51 and the outer cylinder portion 53. A portion of the outer cylinder portion 53 is housed in a concave portion 20*a* that is hollowed from a surface of the casing 20. The outer cylinder portion 53 is fixed to the casing 20 of the outboard motor main body 2 by a fixing member 24. The fixing member 24 is fastened to the casing 20 by a fastening member 25, such as a bolt. The outer cylinder portion 53 may be regarded as an element of the casing 20, and not an element of the anti-vibration mount 12, because the outer cylinder portion 53 is fixed to the casing 20. The fastening member 54 is, for example, a bolt screwed into a screw hole 51*a* of the shaft portion 51. Although not shown, the elastic portion 52 is clamped in the axial direction between a head portion of the bolt and a predetermined portion of the upper bracket 10.

The lower anti-vibration mount 12 has the same configuration as the upper anti-vibration mount 12 except that the shaft portion 51 of the lower anti-vibration mount 12 is integral with the lower bracket 11. In each of the anti-vibration mounts 12, the elastic portion 52 is interposed between the shaft portion 51 fixed to the swivel bracket 7 through the steering shaft 8 and the outer cylinder portion 53 fixed to the casing 20 of the outboard motor main body 2, and is elastically deformable. Therefore, the outboard motor main body 2 is elastically supported by the anti-vibration mount 12. Vibrations of the outboard motor main body 2 are attenuated by the elastic deformation of the elastic portion 52, and thus are prevented from being transmitted to the hull 5*a*.

Figure 5A:
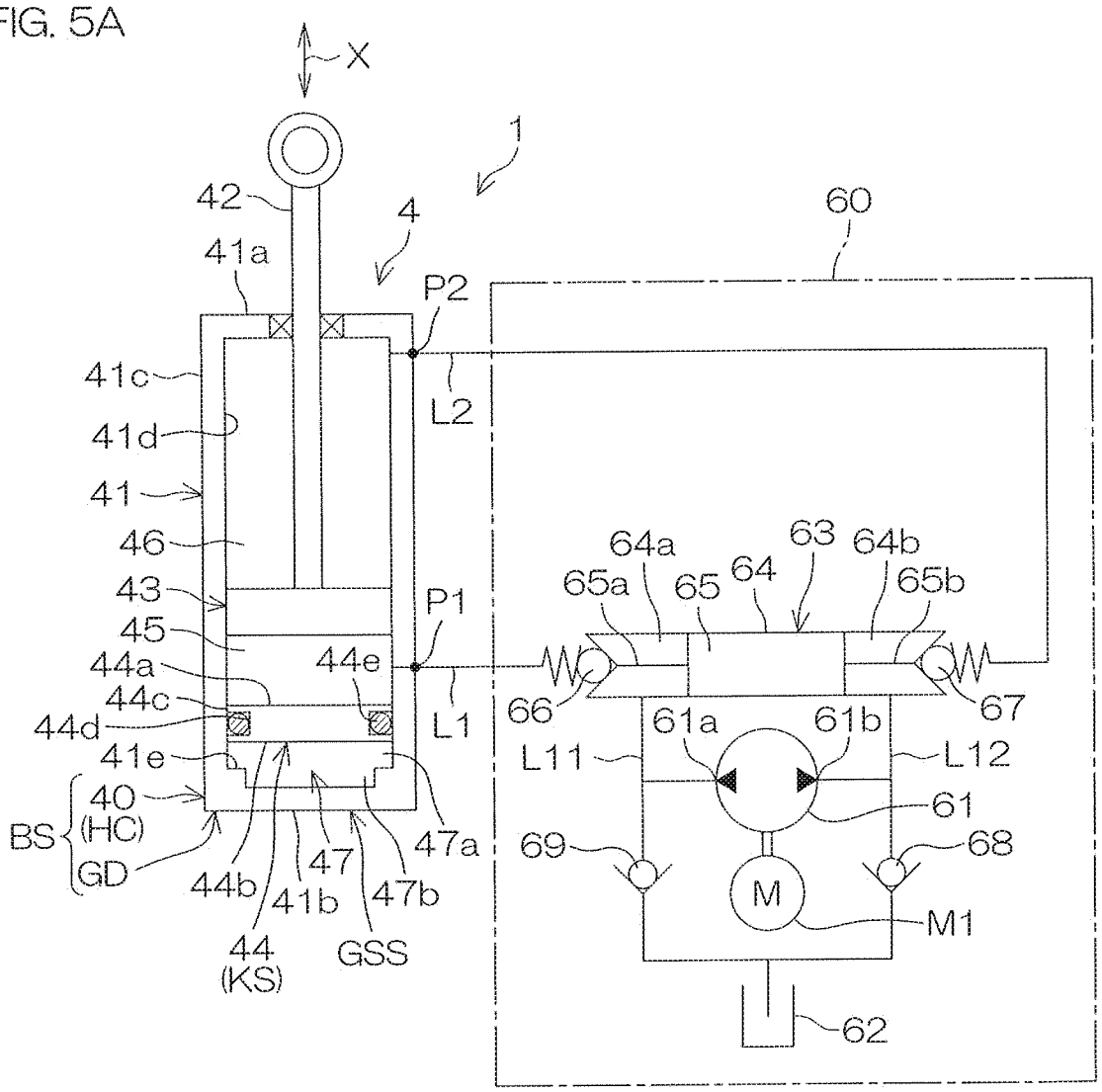
FIG. 5A is a schematic view shown to describe an example of an anti-vibration structure of the outboard motor.

FIG. 5A is a schematic view of a main portion of the PTT mechanism 4, and shows an example of the anti-vibration structure BS of the outboard motor. The tilt cylinder 40 defining the hydraulic cylinder includes the cylinder main body 41, the tilt rod 42, a piston 43, a free piston 44, a pair of oil chambers 45 and 46, and a gas chamber 47 as shown in FIG. 5A.

The cylinder main body 41 includes a circular cylindrical tube having a bottom. The cylinder main body 41 includes a pair of end portions 41*a* and 41*b*, an outer peripheral surface 41*c*, an inner peripheral surface 41*d*, a contact portion 41*e*, a first port P1, and a second port P2. A portion of the tilt rod 42 is inserted in the cylinder main body 41. The piston 43 is housed in the cylinder main body 41, and defines the pair of oil chambers 45 and 46 in the cylinder main body 41. The piston 43 slides in the axial direction of the tilt rod 42 along the inner peripheral surface 41*d* of the cylinder main body 41 in the cylinder main body 41.

The tilt rod 42 extends through, for example, the upper oil chamber 46, which is one of the pair of oil chambers 45 and 46, and extends outwardly from the cylinder main body 41. The tilt cylinder 40 is extendable and contractible in the expansion/contraction direction X corresponding to the axial direction of the tilt rod 42 in response to the movement in the axial direction of the tilt rod 42. The first port P1 includes an opening that extends through the outer peripheral surface 41*c* and the inner peripheral surface 41*d* of the cylinder main body 41 and that communicates with the lower oil chamber 45. The second port P2 includes an opening that extends through the outer peripheral surface 41*c* and the inner peripheral surface 41*d* of the cylinder main body 41 and that communicates with the upper oil chamber 46.

The free piston 44 is housed in the cylinder main body 41. The free piston 44 is located on the side opposite to the tilt rod 42 with respect to the piston 43, and defines the gas chamber 47 in the cylinder main body 41. The free piston 44 is an example of a movable partition KS by which the lower oil chamber 45 and the gas chamber 47 are divided from each other in the cylinder main body 41. The free piston 44 slides in the axial direction of the tilt rod 42 along the inner peripheral surface 41*d* of the cylinder main body 41 in the cylinder main body 41 on the side opposite to the tilt rod 42.

The free piston 44 has a disk shape, and includes two end surfaces 44*a*, 44*b* and an outer peripheral surface 44*c*. The upper end surface 44*a* faces the lower oil chamber 45. The lower end surface 44*b* faces the gas chamber 47. A seal 44*e*, such as an O-ring, is held in a circumferential groove 44*d* provided at the outer peripheral surface 44*c*. The seal 44*e* seals a portion between the outer peripheral surface 44*c* of the free piston 44 and the inner peripheral surface 41*d* of the cylinder main body 41. A gas-filled structure GSS that defines the gas chamber 47 that is filled with gas is provided in the cylinder main body 41 by the free piston 44. The tilt cylinder 40 is able to fulfill a function of a gas damper GD by the gas-filled structure GSS provided in the cylinder main body 41. The gas with which the gas chamber 47 is filled may be air, or may be an inert gas, such as a nitrogen gas. An example of the anti-vibration structure BS of the outboard motor includes the tilt cylinder 40 and the gas damper GD.

In response to the up-and-down movement of the free piston 44, the volume of the gas chamber 47 changes and the inner pressure of the gas chamber 47 changes. The inner pressure of the gas chamber 47 generates a force that extends the tilt rod 42 through the free piston 44 and the piston 43. In other words, the gas damper GD functions as a gas spring in a direction in which the tilt cylinder 40 is extended.

Figure 5B:
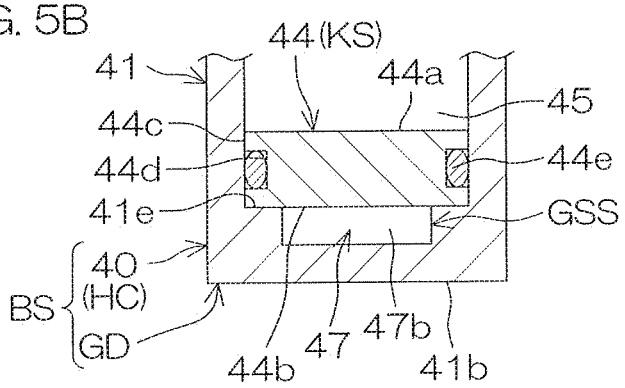
FIG. 5B is a schematic cross-sectional view that describes a function in the example of the anti-vibration structure of the outboard motor of FIG. 5A.

The contact portion 41*e* of the cylinder main body 41 is located in the gas chamber 47. The contact portion 41*e* includes a step that protrudes inwardly from the inner peripheral surface 41*d* of the cylinder main body 41 and that faces the free piston 44. The contact portion 41*e* is in contact with the lower end surface 44*b* of the free piston 44 when the free piston 44 moves to a lower stroke end as shown in FIG. 5B. The gas chamber 47 includes a first portion 47*a* that is located at a higher position than the contact portion 41*e* and a second portion 47*b* that is located at a lower position than the contact portion 41*e*. The position of the stroke end of the free piston 44 is regulated in a state in which the contact portion 41*e* is in contact with the free piston 44. Additionally, the gas chamber 47 is provided only with the second portion 47*b* in a state in which the contact portion 41*e* is in contact with the free piston 44. In other words, the contact portion 41*e* fulfills a function to regulate the minimum volume of the gas chamber 47, and the minimum volume of the gas chamber 47 corresponds to the volume of the second portion 47*b*.

The PTT mechanism 4 includes a hydraulic circuit 60 that supplies/discharges hydraulic oil to the pair of oil chambers 45 and 46 of the tilt cylinder 40. It is configured so that the tilt rod 42 is extended and contracted in response to the supply/discharge of hydraulic oil from the hydraulic circuit 60 to the pair of oil chambers 45 and 46. The hydraulic circuit 60 includes a hydraulic pump 61, a reservoir tank 62, and a main valve assembly 63. The hydraulic pump 61 is driven by the electric motor M1. The electric motor M1 is able to make normal rotation and reverse rotation, and the hydraulic pump 61 is normally rotationally or reversely rotationally driven by the electric motor M1. The main valve assembly 63 is connected to two ports 61*a* and 61*b* of the hydraulic pump 61.

The main valve assembly 63 includes a cylinder 64, a shuttle 65 that slides in the cylinder 64, and two on-off valves 66 and 67 located at both sides of the cylinder 64, respectively. Two oil chambers 64*a* and 64*b* are defined at both sides of the shuttle 65 in the cylinder 64. The two ports 61*a* and 61*b* of the hydraulic pump 61 are joined to the two oil chambers 64*a* and 64*b* through oil passages L11 and L12, respectively. The on-off valves 66 and 67 are check valves, and are opened by an increase in hydraulic pressure in the oil chambers 64*a* and 64*b* corresponding to the on-off valves 66 and 67. Additionally, the on-off valves 66 and 67 are opened by being pressed by corresponding needles 65*a* and 65*b* joined to the shuttle 65. In other words, a shuttle valve includes the shuttle 65 and the needles 65*a* and 65*b*.

The lower oil chamber 45 of the tilt cylinder 40 is joined to the on-off valve 66 of the main valve assembly 63 through the first port P1 and an oil passage L1. The upper oil chamber 46 of the tilt cylinder 40 is joined to the on-off valve 67 of the main valve assembly 63 through the second port P2 and an oil passage L2. The two on-off valves 66 and 67 of the main valve assembly 63 are closed in a state in which the electric motor M1 has stopped running. Therefore, hydraulic oil is not supplied/discharged from the hydraulic circuit 60 to the oil chambers 45 and 46 of the tilt cylinder 40. The gas-filled structure GSS provided in the tilt cylinder 40 functions as a gas damper GD in a state in which hydraulic oil is not supplied/discharged from the hydraulic circuit 60 to the oil chambers 45 and 46 of the tilt cylinder 40.

When the hydraulic pump 61 is normally rotationally driven by the electric motor M1, the hydraulic pump 61 receives hydraulic oil from the port 61*b*, and discharges hydraulic oil from the port 61*a*. The discharged hydraulic oil is supplied from the main valve assembly 63 to the oil passage L1. As a result, the hydraulic oil is supplied to the lower oil chamber 45 of the tilt cylinder 40 through the first port P1. Thus, the tilt rod 42 is extended, and turns the swivel bracket 7 upwardly. Hydraulic oil is replenished from the reservoir tank 62 through a one-way valve 68 when hydraulic oil is insufficient. On the other hand, hydraulic oil in the upper oil chamber 46 of the tilt cylinder 40 is drawn into the hydraulic pump 61 through the second port P2, the oil passage L2, and the main valve assembly 63. At this time, the on-off valve 66 of the main valve assembly 63 is pressed and opened by the needle 65*b* of the shuttle 65.

When the hydraulic pump 61 is reversely rotationally driven by the electric motor M1, the hydraulic pump 61 receives hydraulic oil from the port 61*a*, and discharges hydraulic oil from the port 61*b*. The discharged hydraulic oil is supplied from the main valve assembly 63 to the oil passage L2. As a result, hydraulic oil is supplied to the upper oil chamber 46 of the tilt cylinder 40 through the second port P2. As a result, the tilt rod 42 is contracted, and turns the swivel bracket 7 downwardly. Hydraulic oil is replenished from the reservoir tank 62 through a one-way valve 69 when hydraulic oil is insufficient. On the other hand, hydraulic oil in the lower oil chamber 45 of the tilt cylinder 40 is drawn into the hydraulic pump 61 through the first port P1, the oil passage L1, and the main valve assembly 63. The tilt rod 42 is contracted by being pushed by the swivel bracket 7.

According to the present preferred embodiment, the outboard motor 1 includes the tilt cylinder 40 as an example of a hydraulic cylinder that turns the swivel bracket 7 around the tilt shaft 9 with respect to the clamp bracket 6 as shown in FIG. 1. Additionally, the outboard motor 1 includes the gas damper GD that attenuates an external force that acts in the extension/contraction direction X of the tilt cylinder 40 as shown in FIG. 5A. Therefore, an external force acting in the extension/contraction direction X of the tilt cylinder 40 is attenuated by the gas damper GD. This makes it possible to significantly reduce or prevent vibrations transmitted to the hull 5*a*, and makes it possible to improve the riding comfort of the vessel.

Additionally, the gas damper GD includes the gas-filled structure GSS in the cylinder main body 41 of the tilt cylinder 40 and that is filled with gas. The gas-filled structure GSS in the cylinder main body 41 functions as a damper, and, as a result, an external force that acts in the extension/contraction direction X of the tilt cylinder 40 is attenuated. Therefore, it is possible to significantly reduce or prevent vibrations transmitted to the hull 5*a*.

Additionally, the gas-filled structure GSS includes the free piston 44 that slides in the cylinder main body 41 and that defines the gas chamber 47 in the cylinder main body 41. Gas with which the gas chamber 47 defined by the free piston 44 in the cylinder main body 41 is filled functions as a damper, and, as a result, an external force that acts in the extension/contraction direction X of the tilt cylinder 40 is attenuated. Therefore, it is possible to significantly reduce or prevent vibrations transmitted to the hull 5*a*.

Additionally, the cylinder main body 41 includes the contact portion 41*e* contactable with the free piston 44 so as to regulate the position of a stroke end of the free piston 44 as shown in FIG. 5B. The minimum volume of the gas chamber 47 is regulated in a state in which the contact portion 41*e* is in contact with the free piston 44. Therefore, an increase of the pressure in the gas chamber 47 is regulated.

Additionally, the mount assembly 3 includes the anti-vibration mount 12 that elastically supports the outboard motor main body 2 with respect to the swivel bracket 7 as shown in FIG. 1. The gas damper GD functions as a gas spring having a spring constant lower than that of the anti-vibration mount 12. Therefore, it becomes possible to extend/contract the gas damper GD even when an external force that acts in the extension/contraction direction X of a hydraulic cylinder (for example, the tilt cylinder 40) is small. Therefore, it is possible to improve an anti-vibration effect, and it is possible to further significantly reduce or prevent vibrations transmitted to the hull 5*a*. Particularly, the gas damper GD that functions as a gas spring having a spring constant lower than that of the anti-vibration mount 12 makes it possible to improve an anti-vibration effect when the engine rotates at a low speed during low-speed navigation, such as trolling.

Figure 6A:
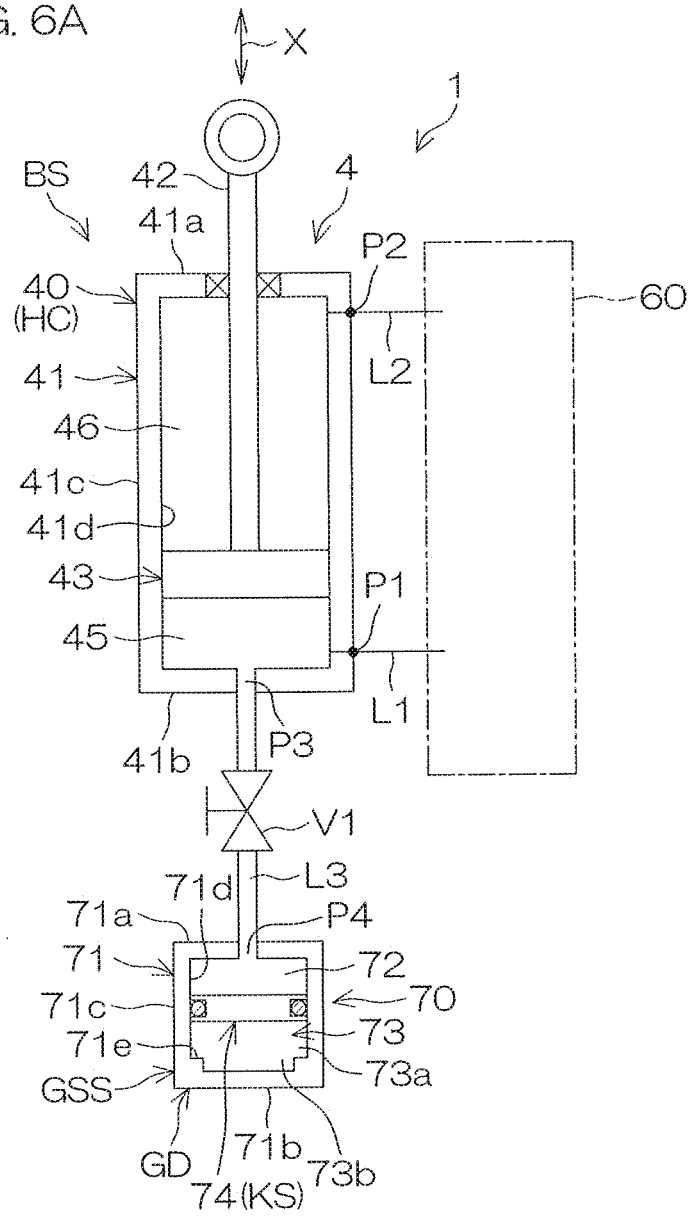
FIG. 6A is a schematic view shown to describe another example of an anti-vibration structure of the outboard motor.

FIG. 6A is a schematic view shown to describe another example of the anti-vibration structure BS in the outboard motor 1. The example of FIG. 6A mainly differs from the example of FIG. 5A as follows. Specifically, the gas damper GD includes a sub-cylinder 70 hydraulically connected to, for example, an oil chamber 45 that is one of the oil chambers 45 of the tilt cylinder 40 and that is an example of a hydraulic cylinder. The sub-cylinder 70 includes a sub-cylinder main body 71, a sub-oil chamber 72, a gas chamber 73, and a free piston 74. The sub-cylinder main body 71 includes a circular cylindrical tube. The cylinder main body 41 includes a pair of end portions 71*a*, 71*b*, an outer peripheral surface 71*c*, an inner peripheral surface 71*d*, and a contact portion 71*e*.

The sub-oil chamber 72 and the gas chamber 73 are located in the sub-cylinder main body 71. The free piston 74 is an example of a movable partition KS that is housed in the sub-cylinder main body 71 and by which the sub-oil chamber 72 and the gas chamber 73 are divided from each other. The free piston 74 slides in the sub-cylinder main body 71. The sub-oil chamber 72 is located at a side of one end portion 71*a* with respect to the free piston 74. The gas chamber 73 is located at the other side of an end portion 71*b* with respect to the free piston 74. An oil passage L3 is provided between the tilt cylinder 40 and the sub-cylinder 70. The oil chamber 45 of the tilt cylinder 40 and the sub-oil chamber 72 of the sub-cylinder 70 are able to communicate with each other through the oil passage L3.

Two ports P3 and P4 are provided at two end portions of the oil passage L3, respectively. The port P3 is located at, for example, the end portion 41*b* of the cylinder main body 41 of the tilt cylinder 40. The port P4 is located at the end portion 71*a* of the sub-cylinder main body 71. For example, an on-off valve V1 that is manually operable is interposed in the oil passage L3. The on-off valve V1 is able to interrupt the flow of hydraulic oil between the oil chamber 45 of the tilt cylinder 40 and the sub-oil chamber 72 of the sub-cylinder 70 in the closed state. The on-off valve V1 allows the flow of hydraulic oil between the oil chamber 45 and the sub-oil chamber 72 in an opened state.

Figure 6B:
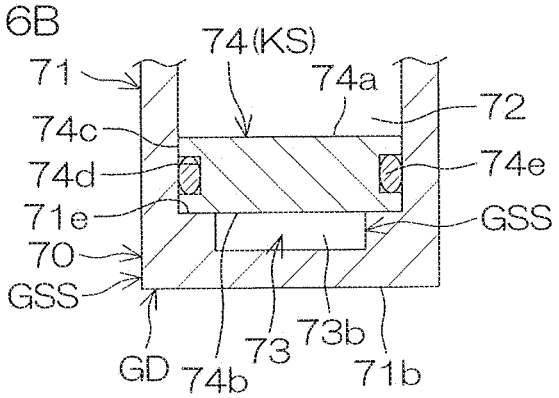
FIG. 6B is a schematic cross-sectional view that describes a function in the example of the anti-vibration structure of the outboard motor of FIG. 6A.

The free piston 74 is the same in configuration as the free piston 44 of FIG. 5A, and includes two end surfaces 74*a*, 74*b*, an outer peripheral surface 74*c*, and a circumferential groove 74*d* as shown in FIG. 6B. The end surface 74*a*, which is one of the two end surfaces, faces the sub-oil chamber 72, and the other end surface 74*b* faces the gas chamber 73. A seal 74*e*, such as an O-ring, is held in the circumferential groove 74*d*. The seal 74*e* seals a portion between the outer peripheral surface 74*c* of the free piston 74 and the inner peripheral surface 71*d* of the sub-cylinder main body 71. A gas-filled structure GSS that defines the gas chamber 73 filled with gas is provided in the sub-cylinder main body 71 by the free piston 74. The sub-cylinder 70 functions as a gas damper GD.

The free piston 74 rises and falls when the tilt cylinder 40 extends and contracts. In response to the up-and-down movement of the free piston 74, the volume of the gas chamber 73 changes and the inner pressure of the gas chamber 73 changes. The inner pressure of the gas chamber 73 generates a force that extends the tilt rod 42 through the free piston 74 and the piston 43. A force that extends the tilt rod 42 increases when the inner pressure of the gas chamber 73 increases in response to the contraction of the tilt cylinder 40. In other words, the gas damper GD functions as a gas spring that resists the contraction of the tilt cylinder 40. Preferably, the gas damper GD functions as a gas spring having a spring constant lower than that of the anti-vibration mount 12.

The contact portion 71*e* of the sub-cylinder main body 71 is located in the gas chamber 73. The contact portion 71*e* includes a step that protrudes inwardly from the inner peripheral surface 71*d* of the sub-cylinder main body 71 and that faces a side of the free piston 74. When the free piston 74 moves to the lower stroke end, the contact portion 71*e* is in contact with the other end surface 74*b* of the free piston 74 as shown in FIG. 6B. The gas chamber 73 includes a first portion 73*a* located higher than the contact portion 71*e* and a second portion 73*b* located lower than the contact portion 71*e*. The position of the stroke end of the free piston 74 is regulated in a state in which the contact portion 71*e* is in contact with the free piston 74. Additionally, the gas chamber 73 is provided only with the second portion 73*b* in a state in which the contact portion 71*e* is in contact with the free piston 74. In other words, the contact portion 71*e* fulfills a function to regulate the minimum volume of the gas chamber 73, and this minimum volume of the gas chamber 73 corresponds to the volume of the second portion 73*b*.

According to the present preferred embodiment, the sub-cylinder 70 hydraulically connected to the oil chamber 45 of the tilt cylinder 40 functions as a gas damper GD, and, as a result, an external force that acts in the extension/contraction direction X of the tilt cylinder 40 is attenuated. Therefore, it is possible to significantly reduce or prevent vibrations transmitted to the hull.

Additionally, in the sub-cylinder main body 71, the sub-oil chamber 72 and the gas chamber 73 are partitioned by the free piston 74. The sub-oil chamber 72 is in communication with the oil chamber 45 of the tilt cylinder 40. Gas with which the gas chamber 73 is filled functions as a damper, and, as a result, an external force that acts in the extension/contraction direction X of the tilt cylinder 40 is attenuated. Therefore, it is possible to significantly reduce or prevent vibrations transmitted to the hull.

Additionally, the sub-cylinder main body 71 includes the contact portion 71*e* that is contactable with the free piston 74 so as to regulate the position of the stroke end of the free piston 74. The contact portion 71*e* regulates the minimum volume of the gas chamber 73 in a state of being in contact with the free piston 74. Therefore, an increase of the pressure in the gas chamber 73 is regulated.

Additionally, the on-off valve V1 that interrupts the flow of hydraulic oil between the oil chamber 45 of the tilt cylinder 40 and the sub-oil chamber 72 of the sub-cylinder 70 is able to be manually operated. The sub-cylinder 70 functions as a gas damper GD in a state in which the on-off valve V1 has been opened. This makes it possible to significantly reduce or prevent vibrations transmitted to the hull. For example, during low-speed navigation, such as trolling, it is possible to improve an anti-vibration effect when the engine rotates at a low speed in a state in which the on-off valve V1 has been opened. It should be noted that the on-off valve V1 is manually closed when the navigation speed of the vessel increases.

Additionally, the gas damper GD functions as a gas spring having a spring constant lower than that of the anti-vibration mount 12, thus making it possible to improve an anti-vibration effect when the engine rotates at a low speed during low-speed navigation, such as trolling.

Figure 7:
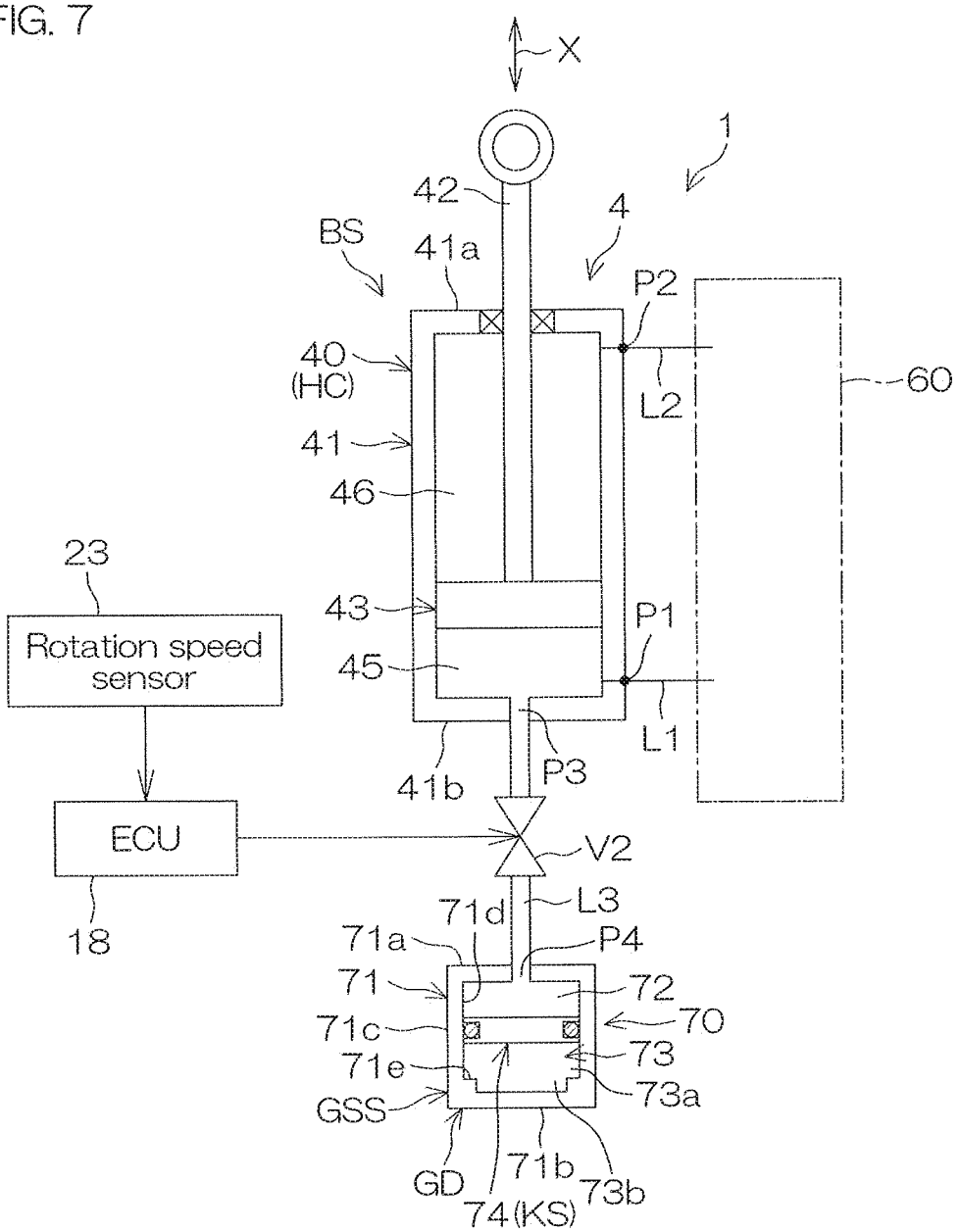
FIG. 7 is a schematic view shown to describe still another example of an anti-vibration structure of the outboard motor.

FIG. 7 is a schematic view shown to describe still another example of the anti-vibration structure BS in the outboard motor 1. The example of FIG. 7 mainly differs from the example of FIG. 6A as follows. Specifically, an electromagnetic control valve V2 is provided as an on-off valve interposed in the oil passage L3 by which the oil chamber 45 of the tilt cylinder 40 and the sub-oil chamber 72 of the sub-cylinder 70 are in communication with each other. The ECU 18, which is an example of a controller, calculates an engine rotation speed of the engine 13, which is an example of a prime mover, based on a detection signal of the rotation speed detector 23. The ECU 18 is configured or programmed to shut off the control valve V2, which is an on-off valve, when the detected rotation speed exceeds a predetermined threshold value. In other words, when the detected engine rotation speed is equal to or below the predetermined threshold value, the control valve V2 is opened.

According to the present preferred embodiment, the same effect as the example of FIG. 6A is achieved. Additionally, when the detection value of the engine rotation speed is lower than the threshold value, the sub-cylinder 70 is able to automatically function as a gas damper GD. This makes it possible to automatically improve an anti-vibration effect when the engine rotates at a low speed during low-speed navigation, such as trolling. This makes it possible to significantly reduce or prevent vibrations transmitted to the hull.

Figure 8:
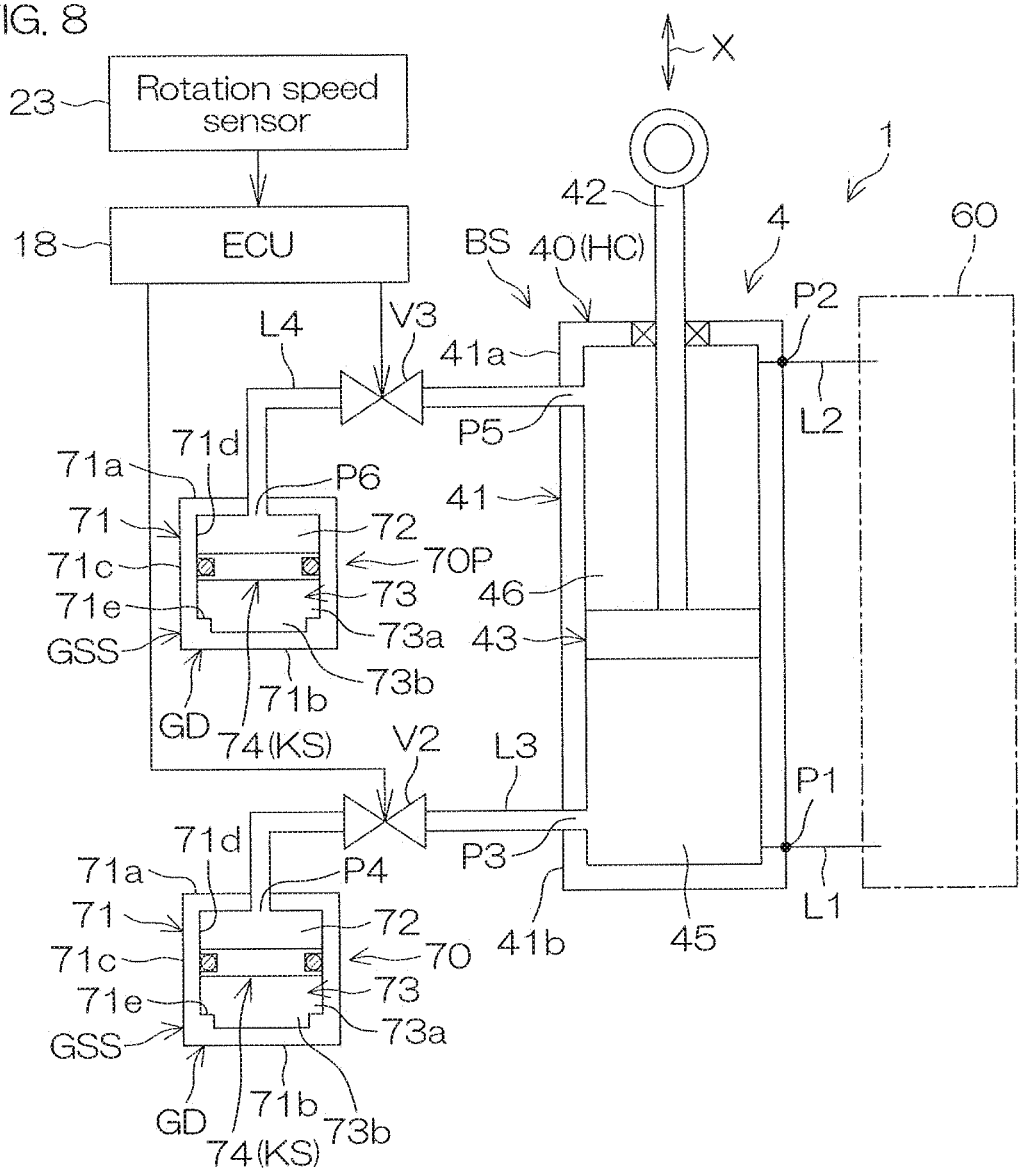
FIG. 8 is a schematic view shown to describe still another example of an anti-vibration structure of the outboard motor.

FIG. 8 is a schematic view shown to describe still another example of the anti-vibration structure BS in the outboard motor 1. The example of FIG. 8 mainly differs from the example of FIG. 7 as follows. Specifically, a sub-cylinder 70P hydraulically connected to the upper oil chamber 46 of the tilt cylinder 40 is provided. The sub-cylinder 70P has the same in configuration as the sub-cylinder 70 hydraulically connected to the lower oil chamber 45 of the tilt cylinder 40. The elements of the sub-cylinder 70P are provided with the same reference characters as the equivalent elements of the sub-cylinder 70. The upper oil chamber 46 of the tilt cylinder 40 and the sub-oil chamber 72 of the sub-cylinder 70P are in communication with each other through an oil passage L4. Two ports P5 and P6 are respectively located at two end portions of the oil passage L4. The port P5 is located at, for example, the end portion 41*a* of the cylinder main body 41 of the tilt cylinder 40. The port P6 is located at the end portion 71*a* of the sub-cylinder main body 71 of the sub-cylinder 70P.

An electromagnetic control valve V3, which is an on-off valve, interrupts the flow of hydraulic oil between the upper oil chamber 46 of the tilt cylinder 40 and the sub-oil chamber 72 of the sub-cylinder 70P. The control valve V3 is interposed in the oil passage L4. The ECU 18 is configured or programmed to shut off the control valve V2 and the control valve V3 when the engine rotation speed detected by the rotation speed detector 23 exceeds a predetermined threshold value. When the detected engine rotation speed is equal to or below the predetermined threshold value, the control valve V2 and the control valve V3 are opened.

When the tilt cylinder 40 that has received an external force in the extension/contraction direction X is extended in a state in which the control valve V2 and the control valve V3 have been opened, hydraulic oil flows from the upper oil chamber 46 to the sub-oil chamber 72 of the sub-cylinder 70P, and gas in the gas chamber 73 of the sub-cylinder 70P is compressed. Additionally, when the tilt cylinder 40 that has received an external force in the extension/contraction direction X is contracted, hydraulic oil flows from the lower oil chamber 45 to the sub-oil chamber 72 of the sub-cylinder 70, and gas in the gas chamber 73 of the sub-cylinder 70 is compressed.

According to this structural configuration, the same effect as the example of FIG. 7 is achieved. Additionally, each of the sub-cylinders 70P and 70 that respectively correspond to the extension and the contraction of the tilt cylinder 40 functions as a gas damper GD. This makes it possible to attenuate an extension/contraction bidirectional external force that acts on the tilt cylinder 40. Therefore, the attenuation effect is high. This makes it possible to further significantly reduce or prevent vibrations transmitted to the hull.

Figure 9:
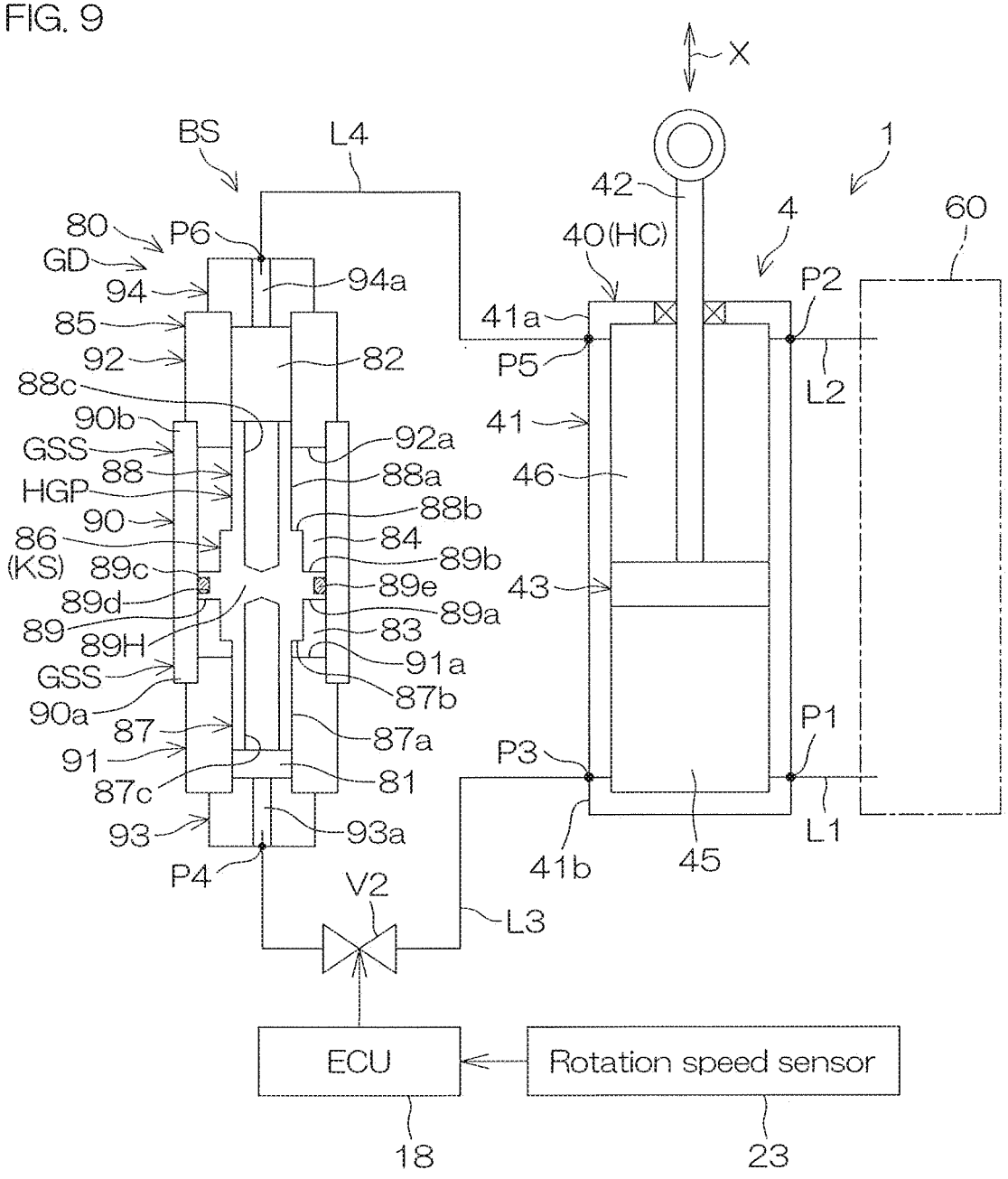
FIG. 9 is a schematic view shown to describe still another example of an anti-vibration structure of the outboard motor.

FIG. 9 is a schematic view shown to describe still another example of the anti-vibration structure BS in the outboard motor 1. The example of FIG. 9 mainly differs from the example of FIG. 8 as follows. Specifically, a single (only one) sub-cylinder 80 hydraulically connected to the two oil chambers 45 and 46 of the tilt cylinder 40 is provided. The sub-cylinder 80 includes two sub-oil chambers 81 and 82 and two gas chambers 83 and 84. The lower oil chamber 45 of the tilt cylinder 40 and the lower sub-oil chamber 81 of the sub-cylinder 80 are in communication with each other through the oil passage L3. The electromagnetic control valve V2, which is an on-off valve, is located in the oil passage L3. The upper oil chamber 46 of the tilt cylinder 40 and the upper sub-oil chamber 82 of the sub-cylinder 80 are in communication with each other through the oil passage L4.

The sub-cylinder 80 includes a sub-cylinder main body 85 and a rod piston 86 that functions as a movable partition KS. The rod piston 86 includes a gas piston 89 and two rods 87 and 88 that extend from a central portion 89H of the gas piston 89. The rod piston 86 provides an all-in-one piston HGP that functions as a hydraulic piston and as a gas piston. The gas piston 89 divides the two gas chambers 83 and 84 from each other. The rod piston 86 divides the two sub-oil chambers 81 and 82 from each other. The lower rod 87 defines a portion of the lower sub-oil chamber 81, and functions as a hydraulic piston. The upper rod 88 defines a portion of the upper sub-oil chamber 82, and functions as a hydraulic piston.

The sub-cylinder main body 85 includes a circular cylindrical center tube 90, two circular cylindrical end tubes 91 and 92, and two end covers 93 and 94. The two end tubes 91 and 92 are fitted and fixed to two end portions 90*a* and 90*b* of the center tube 90. The inner diameter of each of the two end tubes 91 and 92 is smaller than the inner diameter of the center tube 90. The two end covers 93 and 94 cover end portions of the two end tubes 91 and 92.

The gas piston 89 has a disk shape, and is housed in the center tube 90. A gas cylinder is provided with the center tube 90 and the gas piston 89. The gas piston 89 includes two end surfaces 89*a*, 89*b* and an outer peripheral surface 89*c*. The gas piston 89 slides on an inner peripheral surface 90*c* of the center tube 90. A seal 89*e*, such as an O-ring, is housed in a circumferential groove 89*d* provided at the outer peripheral surface 89*c* of the gas piston 89. A portion between the outer peripheral surface 89*c* of the gas piston 89 and the inner peripheral surface 90*c* of the center tube 90 is sealed by the seal 89*e*.

The two rods 87 and 88 of the rod piston 86 functioning as a hydraulic piston extend from a central portion 89H of the gas piston 89 toward mutually opposite sides along a central axis of the center tube 90. The two rods 87 and 88 are inserted in the corresponding end tubes 91 and 92. Each of the rods 87 and 88 is slidable along an inner peripheral surface of a corresponding one of the end tubes 91 and 92. A hydraulic cylinder includes each of the rods 87 and 88 and a corresponding one of the end tubes 91 and 92.

The lower rod 87 includes an outer peripheral surface 87*a*, a step 87*b*, and an axial hole 87*c*. The step 87*b* is located at the outer peripheral surface 87*a*. The axial hole 87*c* has a bottom, and is in communication with the lower sub-oil chamber 81. In some cases, the axial hole 87*c* is not provided. The upper rod 88 includes an outer peripheral surface 88*a*, a step 88*b*, and an axial hole 88*c*. The step 88*b* is provided at the outer peripheral surface 88*a*. The axial hole 88*c* has a bottom, and is in communication with the upper sub-oil chamber 82. In some cases, the axial hole 88*c* is not provided.

The lower sub-oil chamber 81 is defined by the lower rod 87 and by the lower end cover 93 in the lower end tube 91. The lower end cover 93 includes a communication hole 93*a* through which the lower sub-oil chamber 81 and the oil passage L3 are in communication with each other. The port P4 of the end portion of the oil passage L3 is located at an end portion of the communication hole 93*a*. The upper sub-oil chamber 82 is defined by the upper rod 88 and by the upper end cover 94 in the upper end tube 92. The upper end cover 94 includes a communication hole 94*a* through which the upper sub-oil chamber 82 and the oil passage L4 are in communication with each other. The port P6 of the end portion of the oil passage L4 is located at an end portion of the communication hole 94*a*.

The lower gas chamber 83 is surrounded by the outer peripheral surface 87*a* of the lower rod 87, the inner peripheral surface 90*c* of the center tube 90, the lower end surface 89*a* of the gas piston 89, and an end surface 91*a* of the lower end tube 91. Thus, a gas-filled structure GSS is provided. The upper gas chamber 84 is surrounded by the outer peripheral surface 88*a* of the upper rod 88, the inner peripheral surface 90*c* of the center tube 90, the upper end surface 89*b* of the gas piston 89, and an end surface 92*a* of the upper end tube 92. Thus, a gas-filled structure GSS is provided.

When the tilt cylinder 40 that has received an external force in the extension/contraction direction X is contracted in a state in which the control valve V2 has been opened, hydraulic oil flows from the lower oil chamber 45 of the tilt cylinder 40 into the lower sub-oil chamber 81 of the sub-cylinder 80 through the oil passage L3. Therefore, the rod piston 86 and the gas piston 89 rise, and gas in the upper gas chamber 84 is compressed. Additionally, when the tilt cylinder 40 that has received an external force in the extension/contraction direction X is extended, hydraulic oil flows from the upper oil chamber 46 of the tilt cylinder 40 into the upper sub-oil chamber 82 of the sub-cylinder 80. Therefore, the rod piston 86 and the gas piston 89 fall, and gas in the lower gas chamber 83 is compressed.

According to this structural configuration, the single sub-cylinder 80 having gas-filled structures GSS that respectively correspond to the extension and the contraction of the tilt cylinder 40 functions as an extension/contraction bidirectional gas damper GD. Therefore, the use of the single sub-cylinder 80 makes it possible to attenuate an extension/contraction bidirectional external force that acts on the tilt cylinder 40. Therefore, the attenuation effect is high. This makes it possible to further significantly reduce or prevent vibrations transmitted to the hull.

Additionally, the step 87*b* of the lower rod 87 is in contact with the end surface 91*a* of the lower end tube 91 that is an example of the contact portion, and, as a result, the minimum volume of the lower gas chamber 83 is regulated. Additionally, the step 88*b* of the upper rod 88 is in contact with the end surface 92*a* of the upper end tube 92 that is an example of the contact portion, and, as a result, the minimum volume of the upper gas chamber 84 is regulated. This makes it possible to control an increase of the inner pressure in each of the gas chambers 83 and 84.

Figure 10:
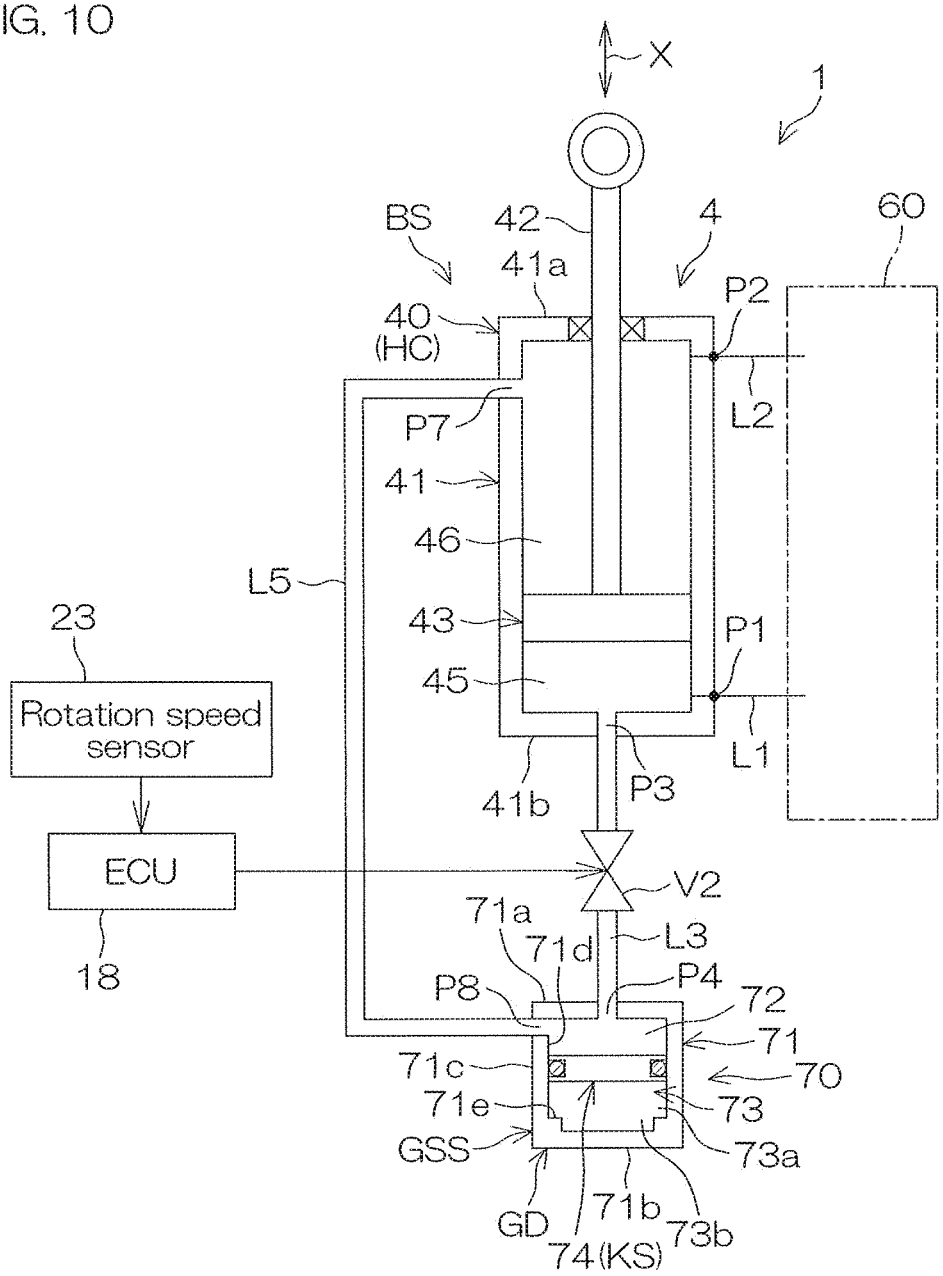
FIG. 10 is a schematic view shown to describe still another example of the anti-vibration structure of the outboard motor.

FIG. 10 is a schematic view shown to describe still another example of the anti-vibration structure BS in the outboard motor 1. The example of FIG. 10 mainly differs from the example of FIG. 7 as follows. Specifically, the upper oil chamber 46 of the tilt cylinder 40 is in communication with the sub-oil chamber 72 of the sub-cylinder 70 through an oil passage L5. The two oil chambers 45 and 46 of the tilt cylinder 40 are both in communication with the sub-oil chamber 72 of the sub-cylinder 70. A port P7, which is one of two ports P7, P8 of end portions of the oil passage L5, is located at the end portion 41*a* of the cylinder main body 41 of the tilt cylinder 40. The other port P8 is located at the end portion 71*a* of the sub-cylinder main body 71.

When the tilt cylinder 40 that has received an external force in the extension/contraction direction X is contracted in a state in which the control valve V2 has been opened, hydraulic oil flows from the lower oil chamber 45 of the tilt cylinder 40 into the sub-oil chamber 72 through the oil passage L3. When the tilt cylinder 40 is extended, hydraulic oil flows from the upper oil chamber 46 of the tilt cylinder 40 into the sub-oil chamber 72 through the oil passage L5. Either when the tilt cylinder 40 is extended or when the tilt cylinder 40 is contracted, the free piston 74 falls, and gas in the gas chamber 73 is compressed.

According to this structural configuration, the single sub-cylinder 70 functions as an extension/contraction bidirectional gas damper GD. Therefore, the use of the single sub-cylinder 70 makes it possible to attenuate an extension/contraction bidirectional external force that acts on the tilt cylinder 40. Therefore, the attenuation effect is high. This makes it possible to further significantly reduce or prevent vibrations transmitted to the hull.

Figure 11:
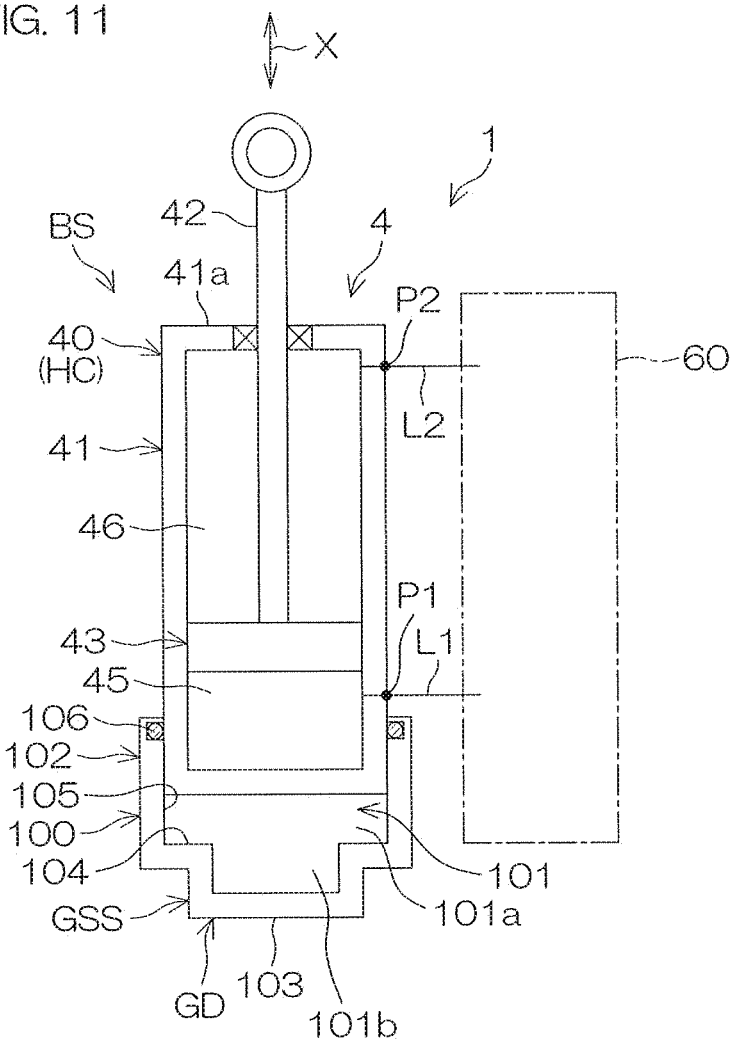
FIG. 11 is a schematic view shown to describe still another example of an anti-vibration structure of the outboard motor.

FIG. 11 is a schematic view shown to describe still another example of the anti-vibration structure BS in the outboard motor 1. The example of FIG. 11 mainly differs from the example of FIG. 6A as follows. Specifically, the gas damper GD includes a gas cylinder 100. The gas cylinder 100 slidably houses the end portion 41*b* of the cylinder main body 41 of the tilt cylinder 40 on the side opposite to the tilt rod 42. The gas cylinder 100 defines a gas chamber 101, filled with gas, with the end portion 41*b* of the cylinder main body 41 of the tilt cylinder 40. When the tilt cylinder 40 receives an external force in the extension/contraction direction X, the cylinder main body 41 of the tilt cylinder 40 slides in the gas cylinder 100, and the inner pressure of gas in the gas chamber 101 changes. The gas cylinder 100 includes a circular cylindrical cylinder tube 102, a bottom 103 that closes one end of the cylinder tube 102, and a contact portion 104. The bottom 103 of the gas cylinder 100 is coupled to a clamp bracket.

The contact portion 104 is located in the gas chamber 101. A seal 106, such as an O-ring, is interposed between an inner peripheral surface 105 of the cylinder tube 102 and the outer peripheral surface 41*c* of the cylinder main body 41. The seal 106 is held in a circumferential groove provided at, for example, the inner peripheral surface of the cylinder tube 102. The contact portion 104 may include a step that protrudes inwardly from the inner peripheral surface 105 of the cylinder tube 102 and that faces the end portion 41*b* side of the cylinder main body 41 of the tilt cylinder 40. The gas chamber 101 includes a first portion 101*a* that is located at a higher position than the contact portion 104 and a second portion 101*b* that is located at a lower position than the contact portion 104. The gas chamber 101 is provided only with the second portion 101*b* in a state in which the contact portion 104 is in contact with the end portion 41*b* of the cylinder main body 41 of the tilt cylinder 40. In other words, the contact portion 104 fulfills a function to regulate the minimum volume of the gas chamber 101, and the minimum volume of the gas chamber 101 corresponds to the volume of the second portion 101*b*.

According to this structural configuration, the gas cylinder 100 that slidably houses the end portion 41*b* of the cylinder main body 41 of the tilt cylinder 40 on the side opposite to the tilt rod 42 functions as a gas damper GD, and, as a result, an external force that acts in the extension/contraction direction X of the tilt cylinder 40 is attenuated. This makes it possible to significantly reduce or prevent vibrations transmitted to the hull.

Additionally, the contact portion 104 of the gas cylinder 100 is contactable with the end portion 41*b* of the cylinder main body 41, and, as a result, the position of the stroke end of the end portion 41*b* of the cylinder main body 41 with respect to the gas cylinder 100 is regulated. Thus, the minimum volume of the gas chamber 101 is regulated, and an increase of the pressure in the gas chamber 101 is regulated.

Figure 12:
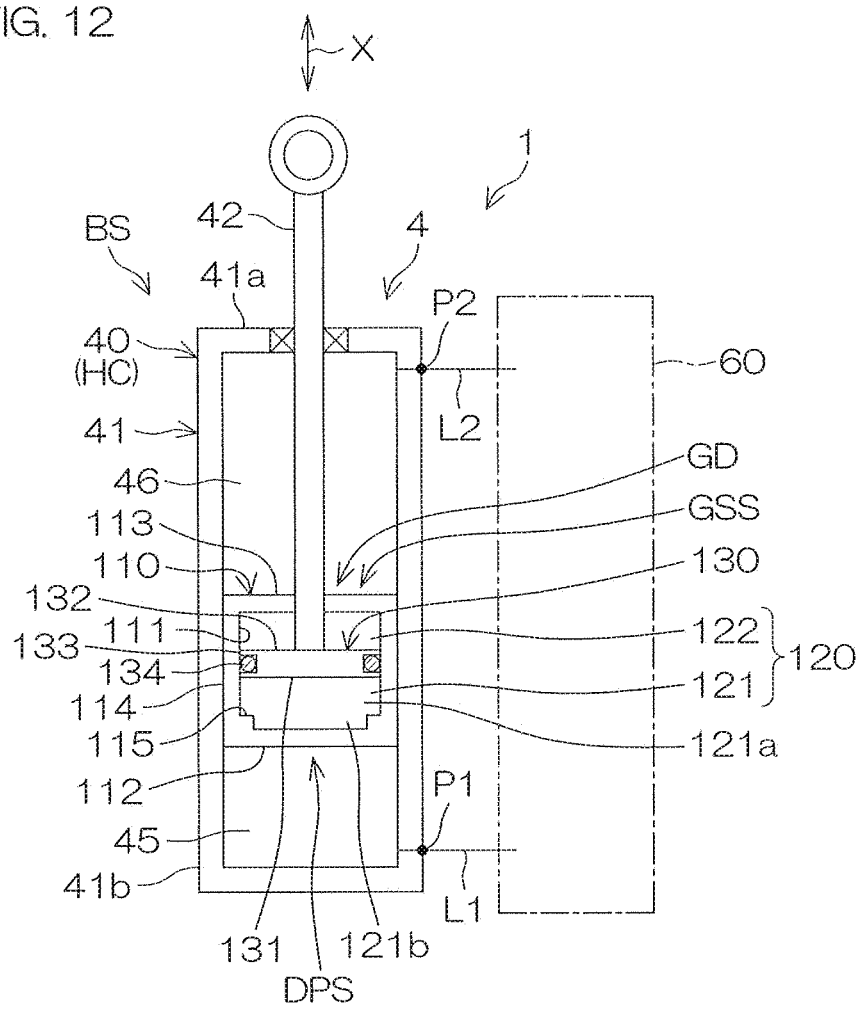
FIG. 12 is a schematic view shown to describe still another example of an anti-vibration structure of the outboard motor.

FIG. 12 is a schematic view shown to describe still another example of the anti-vibration structure BS in the outboard motor 1. The example of FIG. 12 mainly differs from the example of FIG. 5A as follows. Specifically, a hollow piston 110 is included as a piston of the tilt cylinder 40. The hollow piston 110 includes a cylindrical inner peripheral surface 111 that defines a gas chamber 120 that is filled with gas. In other words, the hollow piston 110 includes a gas-filled structure GSS. The gas damper GD includes a double piston structure DPS including the hollow piston 110 and an internal piston 130.

The hollow piston 110 includes two end walls 112, 113 and a peripheral sidewall 114. A gas chamber 120 is defined in the hollow piston 110 by being surrounded by the two end walls 112, 113 and the peripheral sidewall 114. The inner peripheral surface 111 of the hollow piston 110 includes an inner peripheral surface of the peripheral sidewall 114. The tilt rod 42 is inserted through the upper end wall 113, and is coupled to the internal piston 130. The hollow piston 110 includes a contact portion 115.

The internal piston 130 is housed in the hollow piston 110 so as to be slidable on the inner peripheral surface 111 of the hollow piston 110. The internal piston 130 coupled to the tilt rod 42 partitions the gas chamber 120 into two gas chambers 121, 122. The internal piston 130 includes two end surfaces 131, 132, an outer peripheral surface 133, and a seal 134 such as an O-ring. The lower gas chamber 121 is located between the lower end surface 131 of the internal piston 130 and the lower end wall 112 of the hollow piston 110. The upper gas chamber 122 is located between the upper end surface 132 of the internal piston 130 and the upper end wall 113 of the hollow piston 110. The seal 134 is held by a circumferential groove provided at the outer peripheral surface 133 of the internal piston 130, and seals a portion between the outer peripheral surface 133 of the internal piston 130 and the inner peripheral surface 111 of the hollow piston 110. The tilt cylinder 40 that has received an external force in the extension/contraction direction X is extended and contracted in a state in which the supply/discharge of hydraulic oil from the hydraulic circuit 60 to the oil chambers 45 and 46 of the tilt cylinder 40 have been stopped. In accordance with the extension and contraction, a corresponding one of the gas chambers 121, 122 is compressed, and the function as a gas damper GD is achieved.

The contact portion 115 includes a step that protrudes inwardly from the inner peripheral surface 111 of the hollow piston 110 in the lower gas chamber 121 and that faces the internal piston 130 side. When the internal piston 130 moves to the lower stroke end in the hollow piston 110, the contact portion 115 is in contact with the internal piston 130. The lower gas chamber 121 includes a first portion 121*a* that is located at a higher position than the contact portion 115 and a second portion 121*b* that is located at a lower position than the contact portion 115. Although not shown, the position of the stroke end of the internal piston 130 is regulated in a state in which the contact portion 115 is in contact with the internal piston 130. Additionally, the lower gas chamber 121 is provided only with the second portion 121*b* in a state in which the contact portion 115 is in contact with the internal piston 130. In other words, the contact portion 115 fulfills a function to regulate the minimum volume of the gas chamber 121, and the minimum volume of the gas chamber 121 corresponds to the volume of the second portion 121*b*.

According to this structural configuration, the internal piston 130 performs a stroke in the hollow piston 110 in response to the extension/contraction of the tilt rod 42, and, as a result, gas in a corresponding one of the gas chambers 121, 122 in the hollow piston 110 is compressed. Thus, an external force that acts in the extension/contraction direction X of the tilt cylinder 40 is attenuated. This makes it possible to significantly reduce or prevent vibrations transmitted to the hull.

Additionally, the contact portion 115 of the hollow piston 110 is in contact with the internal piston 130, and, as a result, the position of the stroke end of the internal piston 130 with respect to the hollow piston 110 is regulated. Thus, the minimum volume of the gas chamber 121 is regulated, and an increase of the pressure in the gas chamber 121 is regulated.

Although not shown, a contact portion may be added in the upper gas chamber 122. The contact portion is in contact with the internal piston 130, and regulates the minimum volume of the upper gas chamber 122 when the internal piston 130 moves to the upper stroke end in the hollow piston 110. Thus, an increase of the pressure in the gas chamber 122 is regulated.

Figure 13:
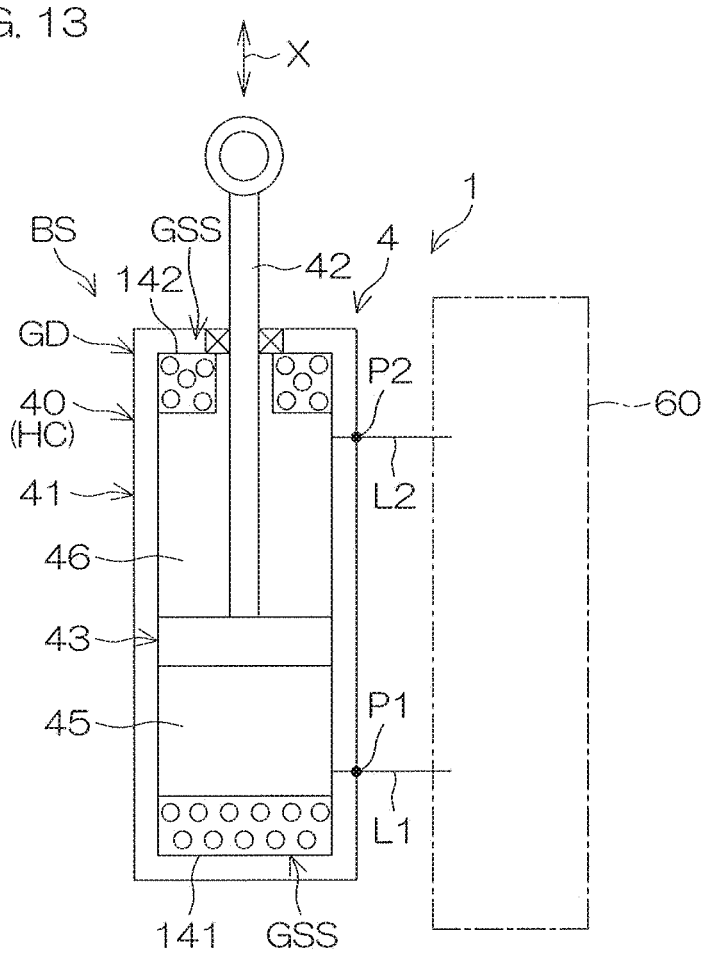
FIG. 13 is a schematic view shown to describe still another example of an anti-vibration structure of the outboard motor.

FIG. 13 is a schematic view shown to describe still another example of the anti-vibration structure BS in the outboard motor 1. The gas damper GD includes two independent cellular foams 141, 142 located in the two oil chambers 45 and 46, respectively. The independent cellular foams 141, 142 provide a gas-filled structure GSS in the cylinder main body 41 of the tilt cylinder 40. The independent cellular foams 141, 142 are made of resin foam or foamed rubber. According to this structural configuration, an external force that acts in the extension/contraction direction X of the tilt cylinder 40 is attenuated by the independent cellular foams 141, 142 located in the two oil chambers 45 and 46. This makes it possible to significantly reduce or prevent vibrations transmitted to the hull.

Figure 14A:
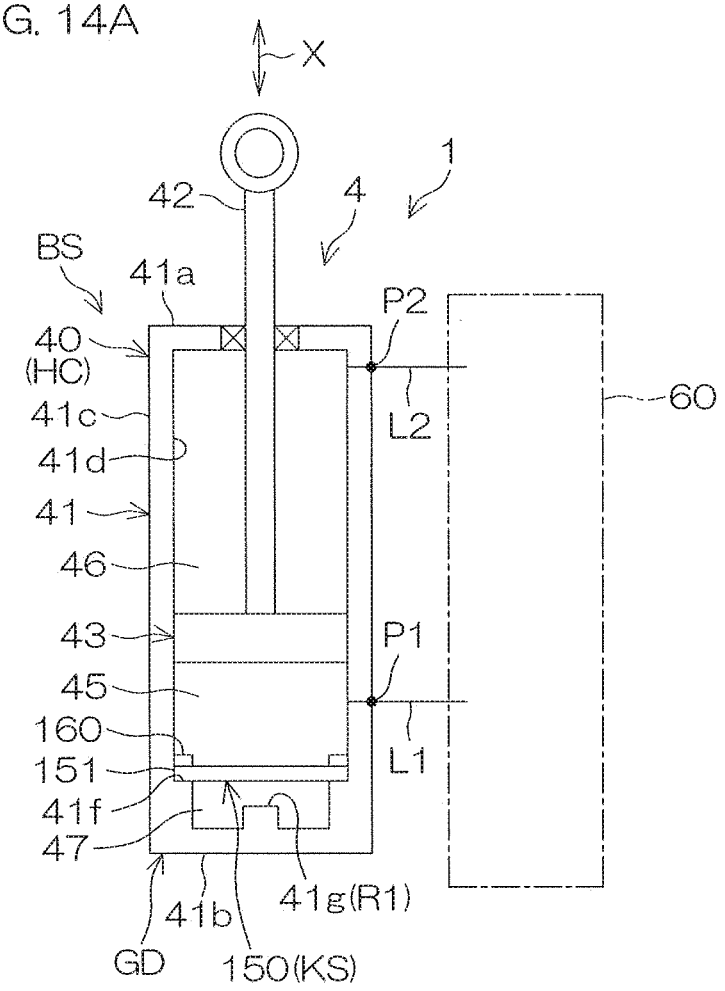
FIG. 14A is a schematic view shown to describe still another example of an anti-vibration structure of the outboard motor.
Figure 14B:
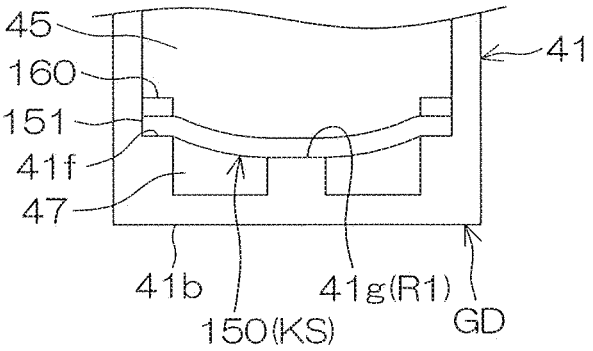
FIG. 14B is a schematic cross-sectional view that describes a function in the example of the anti-vibration structure of the outboard motor of FIG. 14A.

FIG. 14A is a schematic view shown to describe still another example of the anti-vibration structure BS in the outboard motor 1. The example of FIG. 14A mainly differs from the example of FIG. 5A as follows. Specifically, the gas damper GD includes a movable partition KS that defines the gas chamber 47 in the cylinder main body 41 of the tilt cylinder 40. The movable partition KS includes, for example, a membrane 150. The membrane 150 is made of, for example, rubber having elasticity or a metal sheet. The membrane 150 has, for example, a disk shape, and an outer peripheral edge 151 of the membrane 150 is fixed to a step 41*f* of the inner peripheral surface 41*d* of the cylinder main body 41 by an annular fixing member 160. The gas chamber 47 is defined between the membrane 150 and the end portion 41*b*, which corresponds to a bottom, of the cylinder main body 41. The membrane 150 divides the oil chamber 45 and the gas chamber 47 from each other.

A regulation portion R1 is provided that regulates a displacement amount when the membrane 150 is displaced so as to protrude toward the side of the gas chamber 47 by elastic deformation. The regulation portion R1 is provided with, for example, a convex portion 41*g* that protrudes from the end portion 41*b* of the cylinder main body 41 toward the central portion side of the membrane 150 in the gas chamber 47. According to this structural configuration, gas in the gas chamber 47 defined by the movable partition KS in the tilt cylinder 40 functions as a damper, and, as a result, an external force that acts in the extension/contraction direction X of the tilt cylinder 40 is attenuated. This makes it possible to significantly reduce or prevent vibrations transmitted to the hull.

Additionally, the displacement amount of the membrane 150 functioning as the movable partition KS is regulated by the convex portion 41*g* functioning as the regulation portion R1. Thus, the minimum volume of the gas chamber 47 is regulated. Therefore, an increase of the pressure in the gas chamber 47 is regulated. The movable partition KS may be a diaphragm having elasticity.

In each of the examples described above, as the hydraulic cylinder HC included in the anti-vibration structure BS, the trim cylinder 30 may be used instead of the tilt cylinder 40, or both the tilt cylinder 40 and the trim cylinder 30 may be used. Additionally, in each of the examples of FIG. 8, FIG. 9, and FIG. 10, the manually-operable on-off valve V1 may be used instead of the control valves V2 and V3. Additionally, preferably, the spring constant when the gas damper GD functions as a gas spring is lower than the spring constant of the anti-vibration mount 12 in each of the examples of FIG. 7 to FIG. 14A.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor main body;

a mount assembly to mount the outboard motor main body to a hull, the mount assembly including a clamp bracket to be fixed to the hull and a swivel bracket that is coupled to the clamp bracket through a tilt shaft, turnable around the tilt shaft, and supports the outboard motor main body, the mount assembly further including an elastic mount to elastically support the outboard motor main body with respect to the swivel bracket;

a hydraulic cylinder between the clamp bracket and the swivel bracket to turn the swivel bracket around the tilt shaft with respect to the clamp bracket; and a gas damper to damp an external force that acts in a telescopic direction of the hydraulic cylinder and to function as a gas spring having a spring constant lower than a spring constant of the elastic mount.

2. The outboard motor according to claim 1, wherein the hydraulic cylinder includes a cylinder main body, a piston slidable in the cylinder main body and defining a pair of oil chambers in the cylinder main body, and a rod extending outwardly from the cylinder main body through one of the pair of oil chambers, and is operable to extend and contract the rod by selectively supplying hydraulic oil from a hydraulic circuit to either one of the pair of oil chambers; and the gas damper is inside the cylinder main body and filled with gas.

3. The outboard motor according to claim 2, wherein the gas damper includes a free piston slidable in the cylinder main body on a side opposite to the rod and defines a gas chamber filled with the gas in the cylinder main body.

4. The outboard motor according to claim 3, wherein the cylinder main body includes a contact portion contactable with the free piston to regulate a minimum volume of the gas chamber by regulating a position of a stroke end of the free piston.

5. An outboard motor comprising:

an outboard motor main body;

a mount assembly to mount the outboard motor main body to a hull, the mount assembly including a clamp bracket to be fixed to the hull and a swivel bracket that is coupled to the clamp bracket through a tilt shaft, turnable around the tilt shaft, and supports the outboard motor main body;

a hydraulic cylinder between the clamp bracket and the swivel bracket to turn the swivel bracket around the tilt shaft with respect to the clamp bracket; and a gas damper to damp an external force that acts in a telescopic direction of the hydraulic cylinder; wherein the hydraulic cylinder includes a cylinder main body, a piston slidable in the cylinder main body and defining a pair of oil chambers in the cylinder main body, and a rod extending outwardly from the cylinder main body through one of the pair of oil chambers, and is operable to extend and contract the rod by selectively supplying hydraulic oil from a hydraulic circuit to either one of the pair of oil chambers; and the gas damper includes a sub-cylinder hydraulically connected to at least one of the pair of oil chambers.

6. The outboard motor according to claim 5, wherein the sub-cylinder includes a sub-cylinder main body and a free piston slidable in the sub-cylinder main body that divides a sub-oil chamber in communication with the at least one of the pair of oil chambers of the hydraulic cylinder and a gas chamber filled with the gas from each other.

7. The outboard motor according to claim 6, wherein the sub-cylinder main body includes a contact portion contactable with the free piston to regulate a minimum volume of the gas chamber by regulating a position of a stroke end of the free piston.

8. The outboard motor according to claim 6, wherein the sub-cylinder includes a pair of sub-cylinders, and sub-oil chambers of the pair of sub-cylinders are connected to the pair of oil chambers of the hydraulic cylinder, respectively.

9. The outboard motor according to claim 6, wherein the sub-cylinder includes a single sub-cylinder, and both of the pair of oil chambers of the hydraulic cylinder are in communication with the sub-oil chamber of the single sub-cylinder.

10. The outboard motor according to claim 6, wherein the sub-cylinder includes only a single sub-cylinder;

the gas chamber includes a pair of gas chambers;

the sub-oil chamber includes a pair of sub-oil chambers;

the pair of oil chambers of the hydraulic cylinder are in communication with the sub-oil chambers corresponding to the pair of oil chambers, respectively; and the free piston includes a rod piston that includes a gas piston and a pair of rods, the gas piston divides the pair of gas chambers from each other, the pair of rods extend from the gas piston to both sides in a sliding direction of the free piston, and each of the pair of rods functions as a hydraulic piston defining a portion of the sub-oil chamber corresponding to the rod.

11. The outboard motor according to claim 6, further comprising an on-off valve to interrupt a flow of hydraulic oil between at least one of the pair of oil chambers of the hydraulic cylinder and the sub-oil chamber of the sub-cylinder.

12. The outboard motor according to claim 11, further comprising:

a prime mover to rotate a propeller;

a detector to detect a rotation speed of the prime mover; and a controller configured or programmed to shut off the on-off valve when a rotation speed detected by the detector exceeds a predetermined threshold value.

13. An outboard motor comprising:

an outboard motor main body;

a mount assembly to mount the outboard motor main body to a hull, the mount assembly including a clamp bracket to be fixed to the hull and a swivel bracket that is coupled to the clamp bracket through a tilt shaft, turnable around the tilt shaft, and supports the outboard motor main body;

a hydraulic cylinder between the clamp bracket and the swivel bracket to turn the swivel bracket around the tilt shaft with respect to the clamp bracket; and a gas damper to damp an external force that acts in a telescopic direction of the hydraulic cylinder; wherein the hydraulic cylinder includes a cylinder main body, a piston slidable in the cylinder main body and defining a pair of oil chambers in the cylinder main body, and a rod that extends outwardly from the cylinder main body through one of the pair of oil chambers, and is operable to extend and contract the rod by selectively supplying hydraulic oil from a hydraulic circuit to either one of the pair of oil chambers;

the piston includes a hollow piston including a cylindrical inner peripheral surface that defines a gas chamber filled with gas; and the gas damper includes a double piston structure including the hollow piston and an internal piston housed in the hollow piston slidable on the inner peripheral surface, that is coupled to the rod, and partitions the gas chamber into a pair of gas chambers.

14. The outboard motor according to claim 13, wherein the hollow piston includes a contact portion contactable with the internal piston to regulate a minimum volume of the gas chamber by regulating a position of a stroke end of the internal piston with respect to the hollow piston.

15. The outboard motor according to claim 1, wherein the hydraulic cylinder includes a cylinder main body, a piston slidable in the cylinder main body and defining a pair of oil chambers in the cylinder main body, and a rod that extends outwardly from the cylinder main body through one of the pair of oil chambers, and is operable to extend and contract the rod by selectively supplying hydraulic oil from a hydraulic circuit to either one of the pair of oil chambers; and the gas damper includes a pair of independent foam structures located in the pair of oil chambers, respectively.

16. The outboard motor according to claim 1, wherein the hydraulic cylinder includes a cylinder main body, a piston slidable in the cylinder main body and defining a pair of oil chambers in the cylinder main body, and a rod that extends outwardly from the cylinder main body through one of the pair of oil chambers, and is operable to extend and contract the rod by selectively supplying hydraulic oil from a hydraulic circuit to either one of the pair of oil chambers; and the gas damper includes a movable partition that defines a gas chamber filled with gas in the hydraulic cylinder or in a sub-cylinder that is hydraulically connected to the hydraulic cylinder.

* * * * *